US011674747B2

(12) United States Patent
Kwon et al.

(10) Patent No.: US 11,674,747 B2
(45) Date of Patent: Jun. 13, 2023

(54) REFRIGERATOR

(71) Applicant: SAMSUNG ELECTRONICS CO., LTD., Suwon-si (KR)

(72) Inventors: Juno Kwon, Suwon-si (KR); Jin Jeong, Suwon-si (KR); Gahyeong Kim, Suwon-si (KR); Hocheol Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/749,614

(22) Filed: May 20, 2022

(65) Prior Publication Data

US 2022/0275995 A1 Sep. 1, 2022

Related U.S. Application Data

(63) Continuation of application No. 17/570,960, filed on Jan. 7, 2022, which is a continuation of application No. PCT/KR2021/019918, filed on Dec. 27, 2021.

(30) Foreign Application Priority Data

Jan. 8, 2021 (KR) ..... 10-2021-0002864

(51) Int. Cl.
*F25D 23/12* (2006.01)
*F25D 23/02* (2006.01)
(Continued)

(52) U.S. Cl.
CPC ..... *F25D 23/126* (2013.01); *F25D 11/02* (2013.01); *F25D 23/028* (2013.01); *F25D 23/04* (2013.01);
(Continued)

(58) Field of Classification Search
CPC .... F25D 23/025; F25D 23/028; F25D 23/126; F25D 2331/81; F25D 11/02; F25D 23/04;
(Continued)

(56) References Cited

U.S. PATENT DOCUMENTS 2,276,937 A * 3/1942 Cordova ..... F25D 23/04 222/130
10,605,517 B2 3/2020 Eicher et al.
(Continued)

FOREIGN PATENT DOCUMENTS

EP 2 447 642 5/2012
KR 20-0167164 5/2000
(Continued)

OTHER PUBLICATIONS

International Search Report dated Apr. 22, 2022 from International Application No. PCT/KR2021/019918.
(Continued)

*Primary Examiner* — Cassey D Bauer
(74) *Attorney, Agent, or Firm* — Staas & Halsey LLP

(57) ABSTRACT

A refrigerator including a main body having a storeroom, an inner door rotatably coupled to the main body and having a door opening, an outer door rotatably arranged in front of the inner door to open or close the door opening, a dispenser including a water-intake space and an operation lever and configured to supply water to the water-intake space by manipulation of the operation lever, and an automatic water supplier including a water container installation space formed to have a water container mounted and a water level sensor configured to detect a water level of the water container, and configured to supply water into the water container to fill the water container with a certain amount of water. The water-intake space and the water container instal-
(Continued)

lation space may be arranged in the door opening of the inner door to be accessed while the inner door is closed.

11 Claims, 23 Drawing Sheets

(51) Int. Cl.
*F25D 23/04* (2006.01)
*F25D 11/02* (2006.01)
*F25D 29/00* (2006.01)

(52) U.S. Cl.
CPC ..... *F25D 29/005* (2013.01); *F25D 2323/121* (2013.01); *F25D 2323/122* (2013.01); *F25D 2700/00* (2013.01)

(58) Field of Classification Search
CPC ..... F25D 29/005; F25D 2331/121; F25D 2323/122; F25D 2700/00; F25D 2323/023; F25D 2323/121
USPC ..... 62/377; 312/291
See application file for complete search history.

(56) References Cited

U.S. PATENT DOCUMENTS

| | | | | |
|---|---|---|---|---|
| 10,677,513 | B2 * | 6/2020 | Staud | F25D 23/028 |
| 10,794,628 | B2 | 10/2020 | Park et al. | |
| 2017/0167783 | A1 | 6/2017 | Jeong et al. | |
| 2018/0209718 | A1 | 7/2018 | Staud et al. | |
| 2018/0335246 | A1 * | 11/2018 | Jeong | F25D 23/126 |
| 2019/0337790 | A1 | 11/2019 | Lee | |
| 2020/0223683 | A1 | 7/2020 | Subramanya et al. | |
| 2021/0396459 | A1 | 12/2021 | Kwon et al. | |

FOREIGN PATENT DOCUMENTS

| | | |
|---|---|---|
| KR | 10-2012-0040891 | 4/2012 |
| KR | 30-0766623 | 10/2014 |
| KR | 10-2018-0080056 | 7/2018 |
| KR | 10-2018-0126835 | 11/2018 |

OTHER PUBLICATIONS

U.S. Appl. No. 17/570,960, filed Jan. 7, 2022, Juno Kwon, Samsung Electronics Co., Ltd.
Korean Office Action dated Jul. 28, 2022 for Korean Application No. 10-2021-0002864.
Korean Office Action dated Jul. 28, 2022 for Korean Application No. 10-2022-0053126.
Korean Office Action dated Jul. 28, 2022 for Korean Application No. 10-2022-0053127.
Office Action dated Aug. 1, 2022 for U.S. Appl. No. 17/749,606.
Notice of Allowance dated Nov. 23, 2022 for co-pending U.S. Appl. No. 17/749,606.

* cited by examiner

REFRIGERATOR

CROSS-REFERENCE TO RELATED APPLICATION

This application is a continuation of U.S. application Ser. No. 17/570,960, filed on Jan. 7, 2022, which is a continuation application under 35 U.S.C. § 111(a), of international application No. PCT/KR2021/019918, filed on Dec. 27, 2021, which claims priority under 35 U. S. C. § 119 to Korean Patent Application No. 10-2021-0002864 filed on Jan. 8, 2021, the disclosures of which are incorporated herein by reference in its entirety.

1. Field

The disclosure relates to a refrigerator, and more particularly, to a refrigerator having a dispenser for supplying water by manipulation of an operation lever and an automatic water supplier for automatically supplying water to a water container when the water container is mounted.

2. Background

Refrigerators are home appliances having a main body with storerooms and a cold air supply provided for supplying cold air into the storerooms, to keep food and groceries fresh.

Some refrigerators are equipped with a dispenser configured to supply water to the user from the outside of the refrigerator by manipulation of an operation lever without opening the door.

The dispenser may discharge water only when the user holds down the operation lever. This makes it hard for the user to get plenty of water at once, so the user has to keep pressure on the operation lever until as much water as required is gathered in the container.

SUMMARY

In accordance with an aspect of the disclosure, a refrigerator includes a main body having a storeroom; an inner door rotatably coupled to the main body; an outer door rotatably arranged in front of the inner door; a dispenser configured to supply water based on manipulation of an operation lever; and an automatic water supplier configured to supply water into a water container to fill the water container with a predetermined amount of water, the automatic water supplier including a water container installation space formed to have a water container mountable to the water container installation space, and a water level sensor configured to detect a water level of water in the water container, wherein the dispenser and the automatic water supplier are arranged at the inner door so that the dispenser and the automatic water supplier are accessible while the outer door is opened and the inner door is closed.

The refrigerator may further include a control valve configured to guide water supplied from an external water source to the dispenser or the automatic water supplier.

The control valve may include an inflow port to be connected to the external water source to receive the water; a first outflow port arranged to supply a portion of the water to the dispenser; and a second outflow port arranged to supply another portion of the water to the automatic water supplier.

The control valve may open or close the first outflow port based on the manipulation of the operation lever.

The control valve may open or close the second outflow port based on a detected water level in the water container.

The refrigerator may further include a tray arranged to receive water overflowing from the water container; and an overflow sensor configured to detect a water level of water in the tray, wherein the control valve may open or close the second outflow port based on a detected water level of the tray.

The refrigerator may further include a water supply case in which the operation lever and the water level sensor are installed and which forms the water container installation space.

The inner door may include door-inner sides forming a door-inside space and the door-inside space to be connected to the storeroom, and the water supply case may be mountable on the door-inner sides.

The water supply case may include a cut portion formed behind the water container installation space such that at least one side of a water container while the water container is mounted in the water container installation space is exposed to cold air of the storeroom.

The water supply case may include a valve installation space in which the control valve is mounted.

The water supply case may include a main case in which the water container installation space is formed; and a pair of reinforcing plates couplable onto respective sides of the main case to prevent the main case from being bent due to shrinkage deformation.

The water supply case may include a case bead formed for a door basket having a door-storage space to be mounted.

The water supply case may include an air hole formed at the water supply case so that cold air of the storeroom is supplied into the water container installation space.

The refrigerator may include a first lamp arranged in the water supply case to illuminate the operation lever, and a second lamp arranged in the water supply case to illuminate the water container.

In another aspect of the disclosure, a refrigerator may include a main body having a storeroom; an inner door rotatably coupled to the main body; an outer door rotatably arranged in front of the inner door; an automatic water supplier including a water container installation space formed to have a water container mounted and a water level sensor configured to detect a water level in the water container, and configured to automatically supply water into the water container to fill the water container with a certain amount of water; and a control valve configured to guide or block water supplied from an external water source to the automatic water supplier, wherein the automatic water supplier is arranged at the inner door so that the automatic water supplier is accessed while the outer door is open and the inner door is closed.

The control valve may control water supply into the water container according to a water level in the water container.

The automatic water supplier may include a water container sensor for detecting whether the water container is mounted in the water container installation space, and the control valve may control water supply into the water container based on whether the water container is mounted.

The refrigerator may further include a water supply case in which the water level sensor is installed and which forms the water container installation space.

The water supply case may include a valve installation space in which the control valve is mounted.

The water supply case may include a cut portion formed behind the water container installation space such that at least one side of a water container mounted in the water container installation space is exposed to cold air of the storeroom.

DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Various embodiments of the disclosure provide a refrigerator having an automatic water supplier for supplying water into a water container until the water container is filled with a certain amount of water once the water container is mounted.

Various embodiments of the disclosure provide a refrigerator that minimizes a leak of cold air when an automatic water supplier is accessed.

Various embodiments of the disclosure provide a refrigerator having an automatic water supplier with improved usability.

Various embodiments of the disclosure provide a refrigerator equipped with both a dispenser for supplying water by manipulation of an operation lever and an automatic water supplier for supplying water into a water container until the water container is filled with a certain amount of water once the water container is mounted.

Embodiments of the disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification, ordinal numbers used before components are used to distinguish the components from one another, and do not imply order of arrangement, manufacturing, or importance.

The terms "front", "rear", "upper", "lower", "top", and "bottom" as herein used are defined with respect to the drawings, but the terms may not restrict the shape and position of the respective components.

Reference will now be made in detail to embodiments of the disclosure with reference to accompanying drawings.

Figure 1:
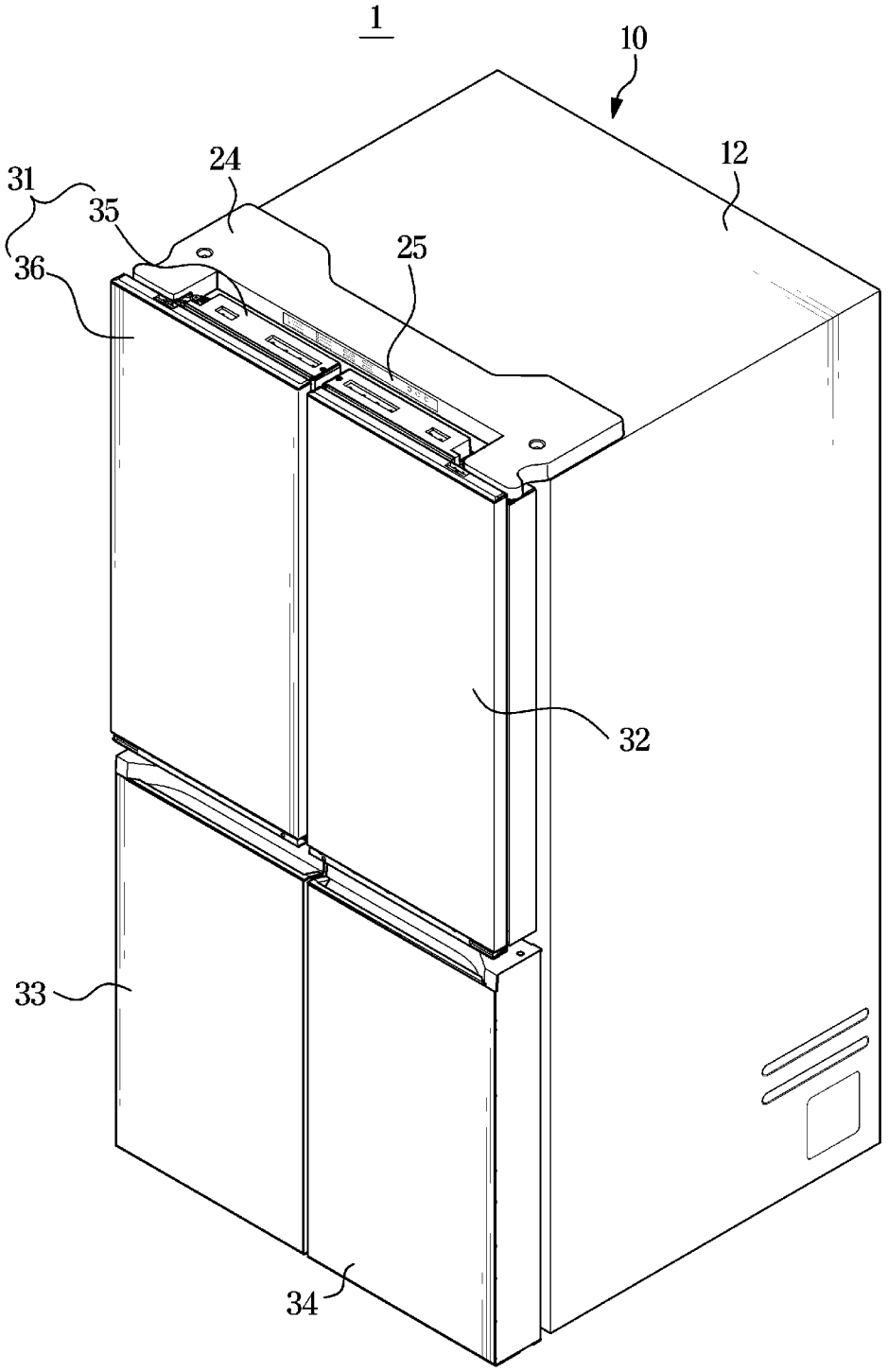
FIG. 1 is a perspective exterior view of a refrigerator, according to an embodiment of the disclosure.
Figure 2:
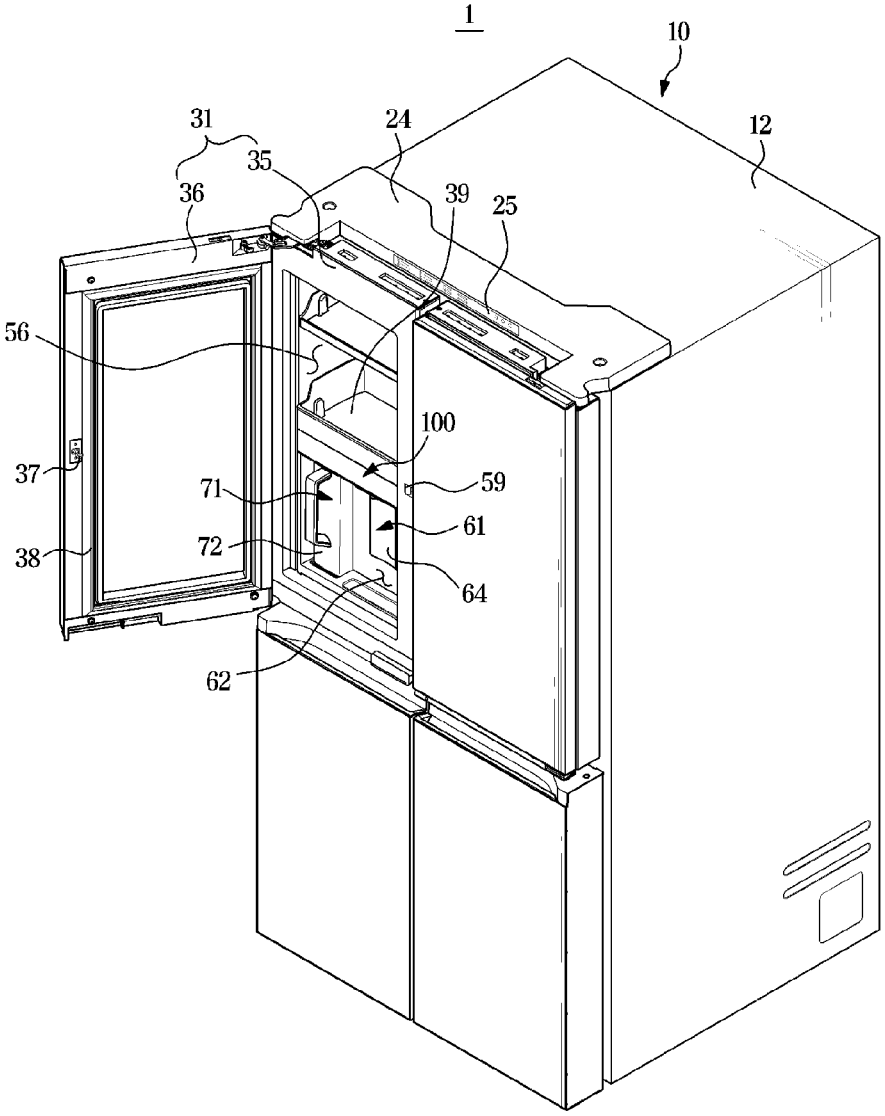
FIG. 2 is a perspective view of a refrigerator with an outer door open, according to an embodiment of the disclosure.
Figure 3:
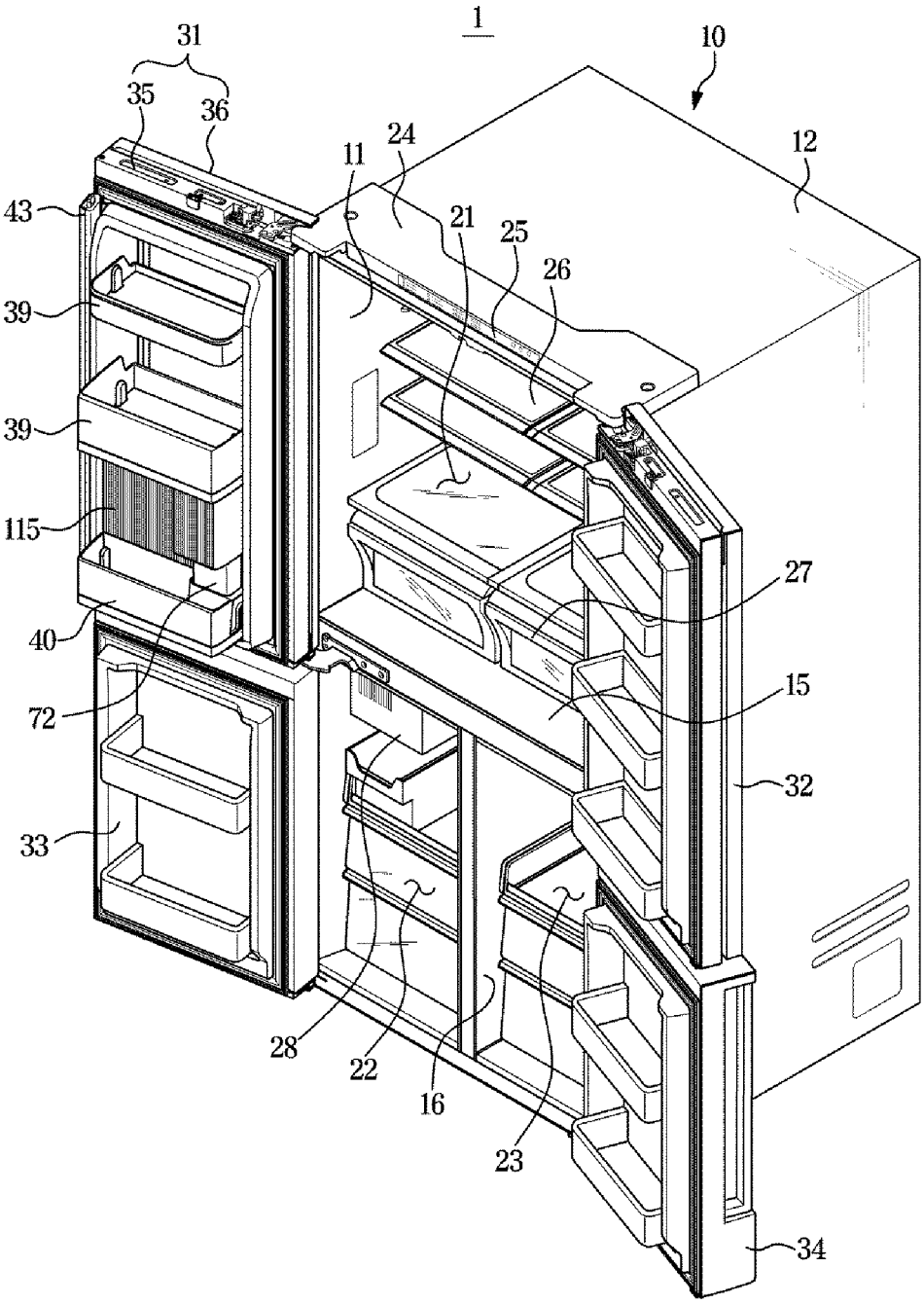
FIG. 3 is a perspective view of a refrigerator with inner doors open, according to an embodiment of the disclosure.
Figure 4:
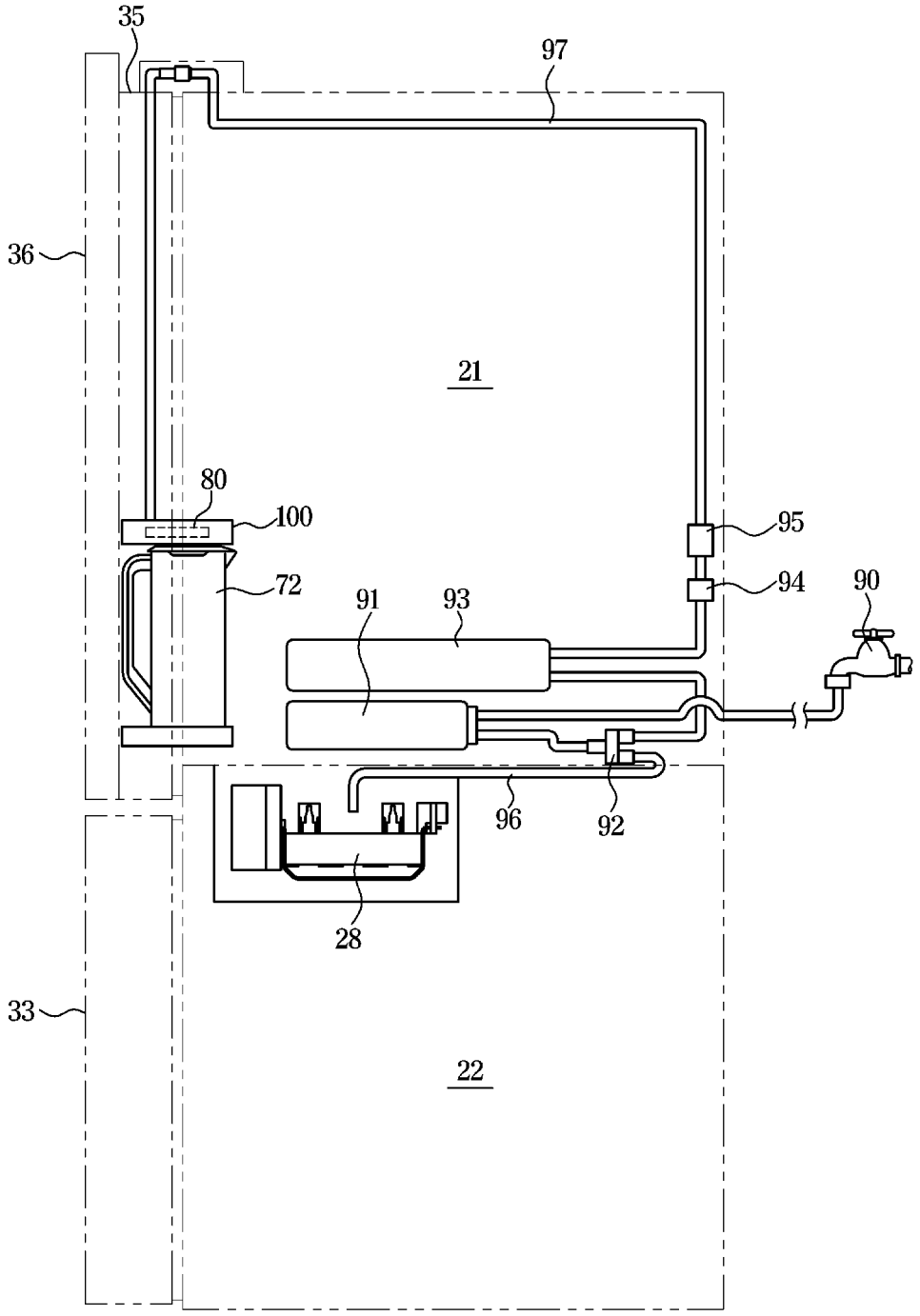
FIG. 4 is a schematic diagram illustrating a water supply flow path of a refrigerator, according to an embodiment of the disclosure.

FIG. 1 is a perspective exterior view of a refrigerator, according to an embodiment of the disclosure. FIG. 2 is a perspective view of a refrigerator with an outer door open, according to an embodiment of the disclosure. FIG. 3 is a perspective view of a refrigerator with inner doors open, according to an embodiment of the disclosure. FIG. 4 is a schematic diagram illustrating a water supply flow path of a refrigerator, according to an embodiment of the disclosure.

Referring to FIGS. 1 and 4, a refrigerator 1 may include a main body 10, storerooms 21, 22, and 23 formed inside the main body 10, doors 31, 32, 33, and 34 to open or close the storerooms 21, 22, and 23, and a cold air supply (not shown) for supplying cold air into the storerooms 21, 22, and 23.

The main body 10 may include an inner case 11 that defines the storerooms 21, 22, and 23, an outer case 12 coupled onto the outer side of the inner case 11 to define the exterior, and insulation (not shown) provided between the inner case 21 and the outer case 23 for insulating the storerooms 21, 22, and 23.

There may be a horizontal partition wall 15 and a vertical partition wall 16 to separate the plurality of storerooms 21, 22, and 23. The storerooms 21, 22, and 23 may be separated by the horizontal partition wall 15 into an upper storeroom 21 and the lower storerooms 22 and 23, and by the vertical partition wall 16 into the lower left storeroom 22 and the lower right storeroom 23.

The upper storeroom 21 may be used as a fridge, and the lower storerooms 22 and 23 may be used as freezers. How the storerooms 21, 22, and 23 are separated and used is not, however, limited thereto.

Furthermore, unlike this embodiment of the disclosure, there may be a side by side (SBS) type refrigerator having a storeroom partitioned by a vertical partition wall into left and right storerooms, a French door refrigerator (FDR) type refrigerator having a storeroom partitioned by a horizontal partition wall into upper and lower refrigeration chambers, or a one door type refrigerator having one storeroom and one door.

There may be shelves 26 on which to put groceries, and storage containers 27 for keeping groceries provided in the storerooms 21, 22, and 23.

The cold air supply may produce cold air using a cooling cycle for compressing, condensing, and evaporating refrigerants, and supply the cold air to the storerooms 21, 22, and 23.

The upper storeroom 21 may be opened or closed by a pair of doors 31 and 32. The doors 31 and 32 may be rotatably coupled to the main body 10. A filler 43 may be arranged at one of the pair of doors 31 and 32, e.g., the door 31, to prevent cold air of the storeroom 21 from leaking between the pair of doors 31 and 32 while the doors 31 and 32 are closed.

The lower left storeroom 22 may be opened or closed by a door 33, which may be rotatably coupled to the main body 10. The lower right storeroom 23 may be opened or closed by a door 34, which may be rotatably coupled to the main body 10.

The doors 31, 32, 33 and 34 may include door baskets 39 and 40 having door-storage space for storing groceries. Gaskets to be tight on the front side of the main body 10 to seal the storerooms 21, 22, and 23 may be provided on the rear side of the doors 31, 32, 33, and 34.

At least one of the doors 31, 32, 33 and 34 may be a double door comprised of an inner door 35 and an outer door 36. For example, the upper left door 31 may include the inner door 35 and the outer door 36.

The inner door 35 may be rotatably coupled to the main body 10 through a hinge. The inner door 35 may have a door-inside space 56. The door-inside space 56 may be formed in a middle portion of the inner door 35 except edge portions. The door-inside space 56 may be formed to extend between the front side and the rear side of the inner door 35. Accordingly, the door-inside space 56 may be connected to the storeroom 21 while the inner door 35 is closed.

The door baskets 39 and 40 may be installed in the door-inside space 56.

A dispenser 61 may be arranged in the door-inside space 56. The dispenser 61 may include an operation lever 64 to operate the dispenser 61 to supply water. The user may push the operation lever 65 with a container (not shown) such as a cup. The operation lever 64 may be movably installed in a lever installation part 110 formed at a water supply case 100.

The dispenser 61 may further include a switch 65 (see FIG. 8) to be turned on by the operation lever 64 when the operation lever 64 is pressed. The dispenser 61 may include a dispenser nozzle 66 (see FIG. 7) through which to discharge water. The dispenser nozzle 66 may be installed at the water supply case 100.

The dispenser 61 may include a water-intake space 62 in which a container to receive water discharged from the dispenser nozzle 66 may be placed. The water-intake space 62 may be hollowed out of the front of the water supply case 100. However, unlike this embodiment of the disclosure, the water-intake space 62 may not be provided when the dispenser nozzle 66 is formed to protrude forward from the water supply case 100.

In the door-inside space 56, there may be an automatic water supplier 71 arranged to include a water container installation space 73 (see FIG. 7) in which to install a water container 72 and a water level sensor 75 for detecting a water level in the water container 72 when the water container is mounted in the water container installation space 73. The automatic water supplier 71 may include an outlet through which to supply water into the water container 72 mounted in the water container installation space 73.

In an embodiment of the disclosure, the outlet may be implemented as a second outflow port 83 of a control valve 80. However, unlike this embodiment of the disclosure, the outlet may be implemented as a separate part instead of the second outflow port 83 of the control valve 80. In this case, the outlet may be connected to the second outflow port 83 through a separate flow path.

The automatic water supplier 71 may automatically supply water into the water container 72 so that the water container 72 is filled with a certain amount of water when the water container 72 is mounted in the water container installation space 73. In other words, the automatic water supplier 71 may perform an auto-fill function. The certain amount of water may correspond to an almost full water amount for the water container 72.

The water container installation space 73 may be hollowed out of the front of the water supply case 100. The water-intake space 62 and the water container installation space 73 may be connected to each other. The water supply case 100 may be installed in the door-inside space 56.

The water level sensor 75 may be installed in the water supply case 100. An outlet may be installed at the water supply case 100.

As described above, the operation lever 64, the switch 65, and the dispenser nozzle 66 of the dispenser 61 may be installed or supported at the water supply case 100, and the water level sensor 75 and the outlet of the automatic water supplier 71 may be installed or supported at the water supply case 100. Furthermore, the water container installation space 73 of the automatic water supplier 71 may be defined by the water supply case 100.

Accordingly, the dispenser 61, the automatic water supplier 71, and the water supply case 100 may be provided in a single assembly. In the disclosure, such an assembly may be referred to as a water supply unit 60.

The water supply unit 60 may be arranged in the door-inside space 56 of the inner door 35. Specifically, the water supply case 100 of the water supply unit 60 may be mounted on door-inner sides 55 that define the door-inside space 56.

As described above, when the inner door 35 is closed, the door-inside space 56 is connected to the storeroom 21, so that the water supply unit 60 may be cooled by cold air of the storeroom 21. Furthermore, the water-intake space 62 and the water container installation space 73 may be formed on the front of the water supply case 100. Accordingly, the water-intake space 62 and the water container installation space 73 may be accessed while the inner door 35 is closed.

The outer door 36 may be arranged to open or close the door-inside space 56 of the inner door 35. A gasket 38 may be provided on the rear side of the outer door 36 to seal the door-inside space 56. The gasket 38 may be tight on a front surface of the inner door 35 around the door-inside space 56.

When the outer door 36 is opened, the door-inside space 56 of the inner door 35 may be accessed. The outer door 36 may be rotatably coupled to the inner door 36 through a hinge 44 (see FIG. 5). The outer door 36 may be turned in the same direction as the inner door 35. The outer door 36 may have a size corresponding to the size of the inner door 35. The outer door 36 may cover the whole area of the inner door 35.

A latch 37 may be arranged at the outer door 36 to be fastened to the inner door 35, and a catch 59 may be arranged at the inner door 35 to interlock with the latch 37.

When the outer door 36 is opened while the latch 37 and the catch 59 are interlocked, the outer door 36 and the inner door 35 are opened together, and when the outer door 36 is opened while the latch 37 and the catch 59 are not interlocked, the outer door 36 may be opened while the inner door 35 is not opened.

A decoration panel (not shown) may be detachably coupled onto the front side of the outer door 36.

A top cover 24 may be coupled onto the top side of the main body 10. The top cover 24 may be provided to cover the hinge and many different electronic parts arranged on the top of the main body 10. A control panel 25 for displaying various states and operation information of the refrigerator 1 or entering various commands for operation of the refrigerator 1 may be arranged on the front side of the top cover 24.

As described in FIG. 4, the refrigerator 1 may include a purifying filter 91 and a water tank 93. The purifying filter 91 may purify water supplied from an external water source 90. The water tank 93 may store water purified by the purifying filter 91. The water tank 93 may be cooled by cold air of the storeroom 21.

An ice maker 23 for forming ice may be arranged in the storeroom 22 of the refrigerator 1. The ice maker 23 may form ice by using the cold air of the storeroom 22.

The refrigerator 1 may include a water supply flow path 97 that forms a flow path connecting the external water source 90 to the control valve 80 to supply water to the dispenser 61 and the automatic water supplier 71, and an ice maker flow path 96 connecting the external water source 90 to the ice maker 23 to supply water to the ice maker 23.

The ice maker flow path 96 and the water supply flow path 97 may be formed to branch off from a point at which a flow path switching valve 92 may be arranged to supply water supplied from the external water source 90 selectively to the control valve 80 or the ice maker 23. The water from the external water source 90 may be supplied to the control valve 80 or the ice maker 28 based on water pressure of the external water source 90 and under the control of the flow path switching valve 92.

The water supply flow path 97 may be arranged to go through the purifying filter 91. Accordingly, the water from the external water source 90 may be purified through the purifying filter 81 and supplied to the control valve 90. The water supply flow path 97 may be arranged to go through the water tank 93. Accordingly, the water from the external water source 90 may be cooled in the water tank 93 and then supplied to the control valve 80.

A water valve 94 may be arranged in the water supply flow path 97. The water valve 94 may control an amount of water to be supplied to the control valve 80 from the water tank 93. A flow sensor 95 may be arranged in the water supply flow path 97 for measuring an amount of water supplied to the control valve 80.

The ice maker flow path 96 may be arranged to go through the purifying filter 91. Accordingly, the water from the external water source 90 may be purified through the purifying filter 81 and supplied to the ice maker 23. The ice maker flow path 96 may not go through the water tank 93 because the water to be supplied to the ice maker 28 is cooled in the ice maker 28 even though not cooled in the water tank 93.

Figure 5:
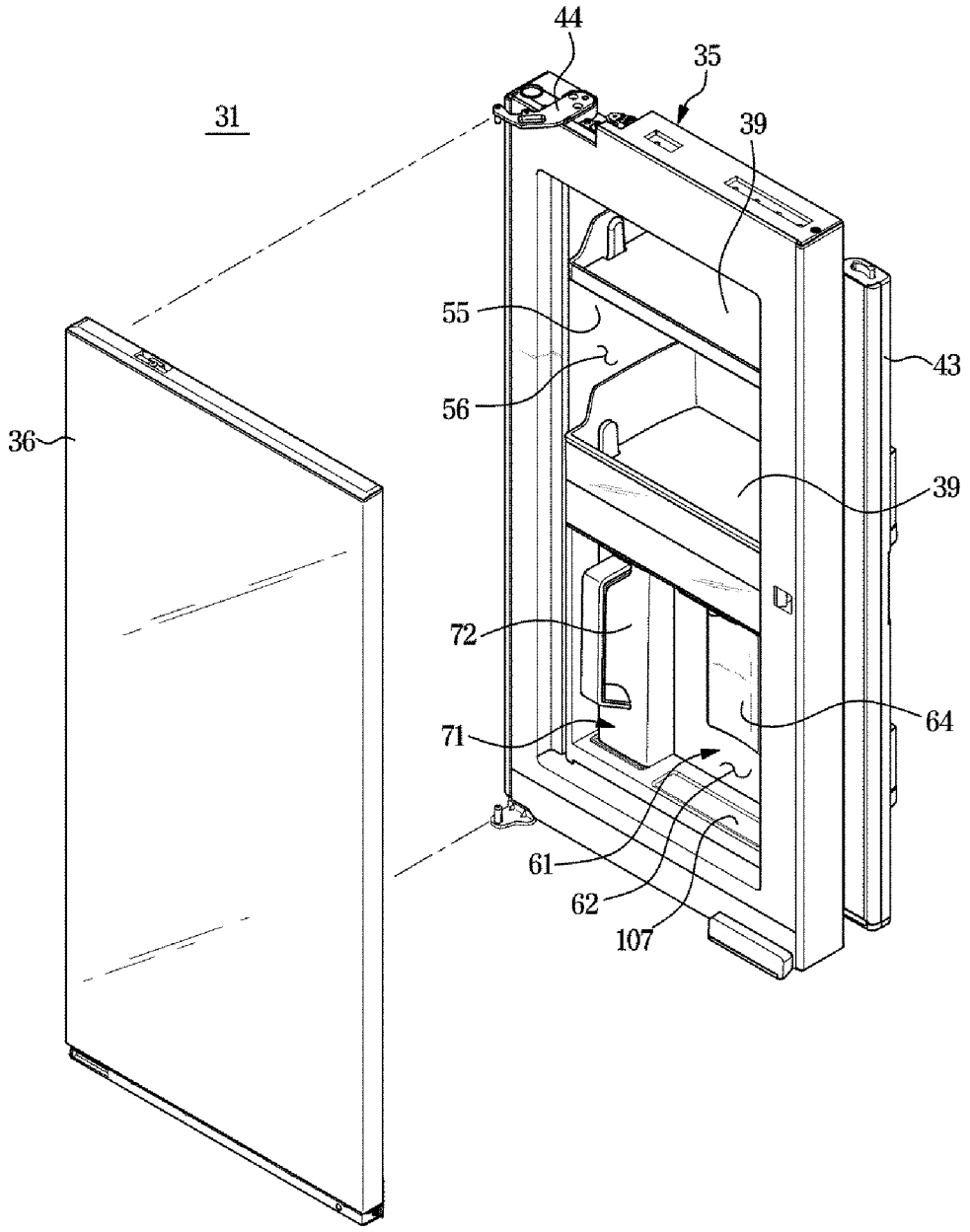
FIG. 5 illustrates an outer door and an inner door of a refrigerator, according to an embodiment of the disclosure.
Figure 6:
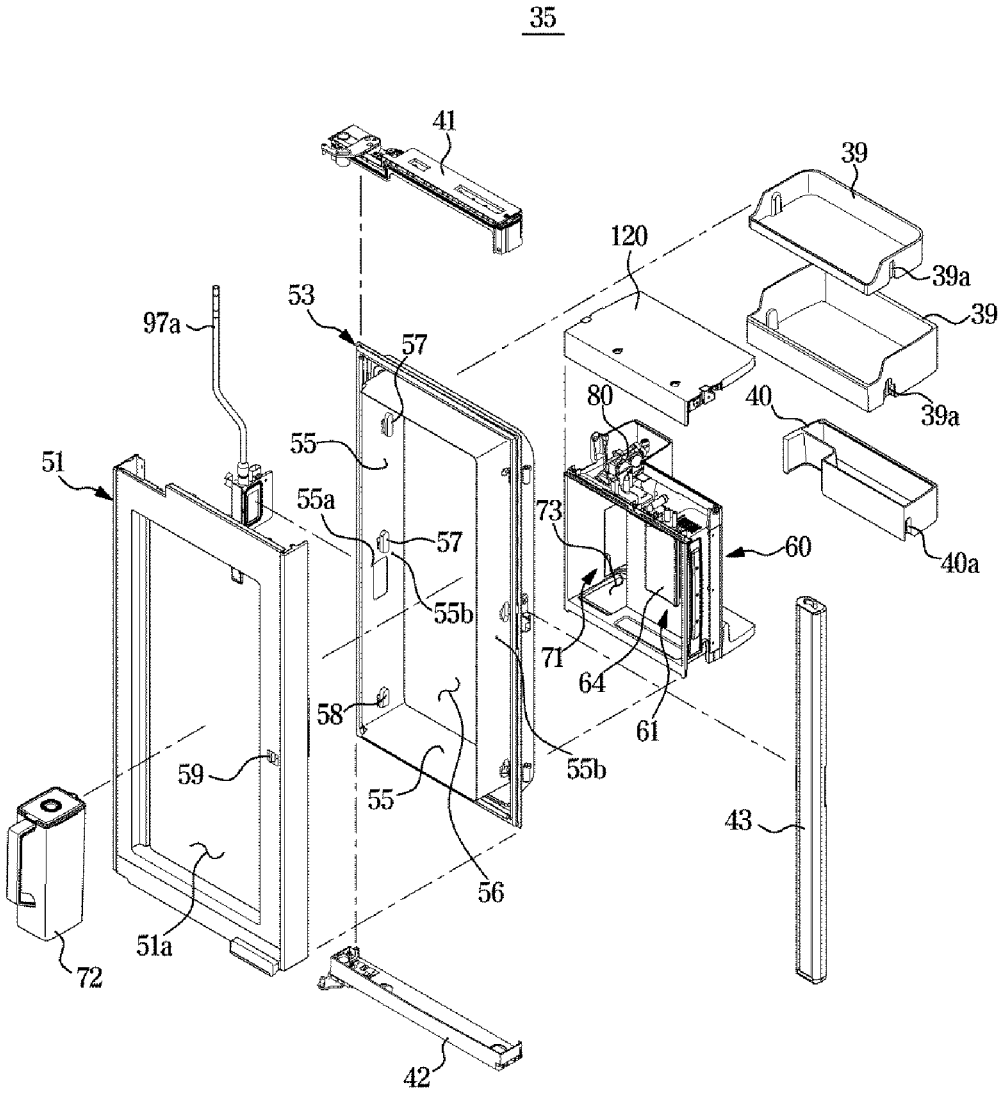
FIG. 6 is an exploded view of an inner door of a refrigerator, according to an embodiment of the disclosure.
Figure 7:
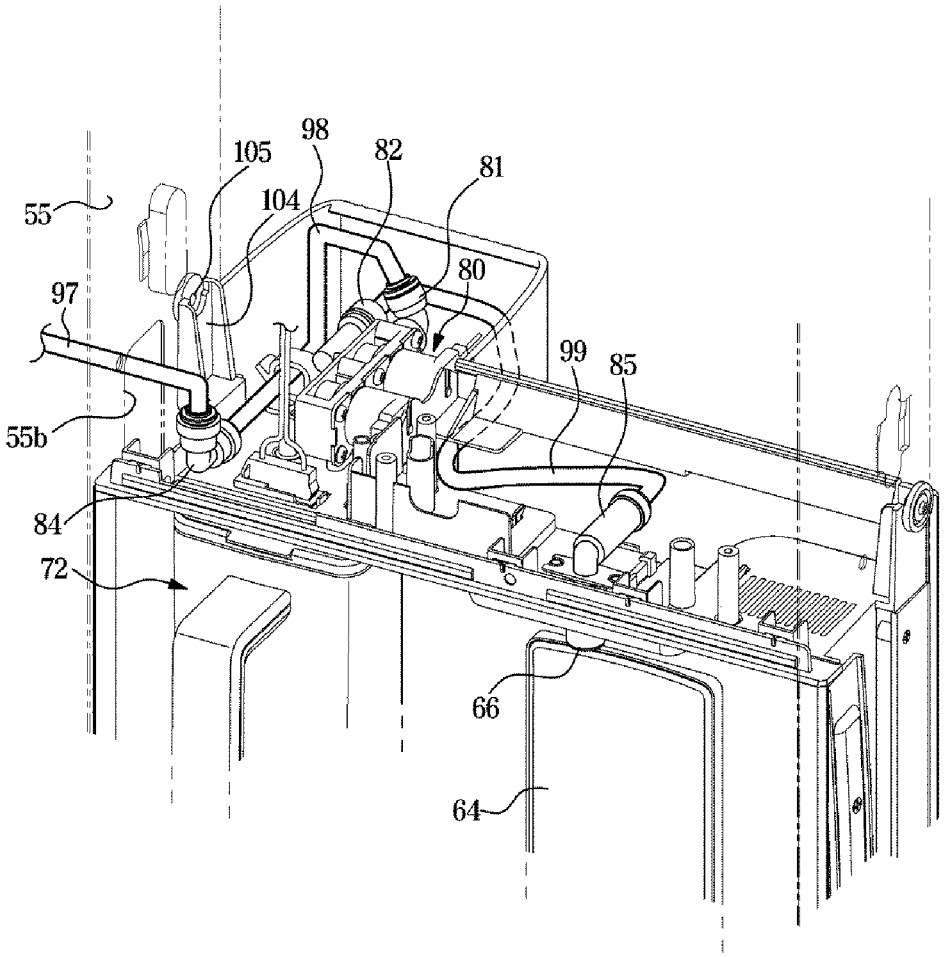
FIG. 7 illustrates a flow path structure of a water supply case of a refrigerator, according to an embodiment of the disclosure.
Figure 8:
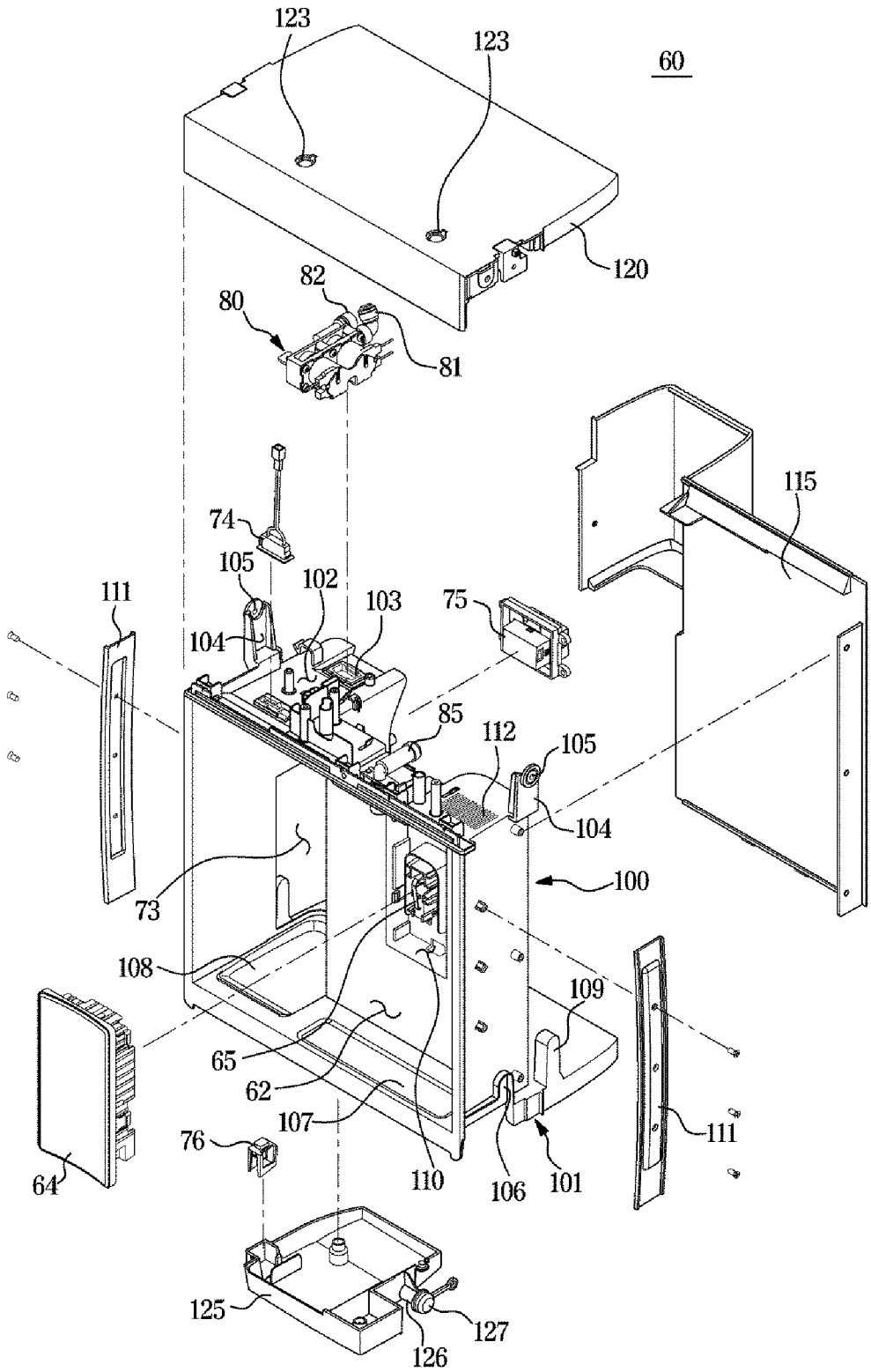
FIG. 8 is an exploded view of a water supply unit of a refrigerator, according to an embodiment of the disclosure.
Figure 9:
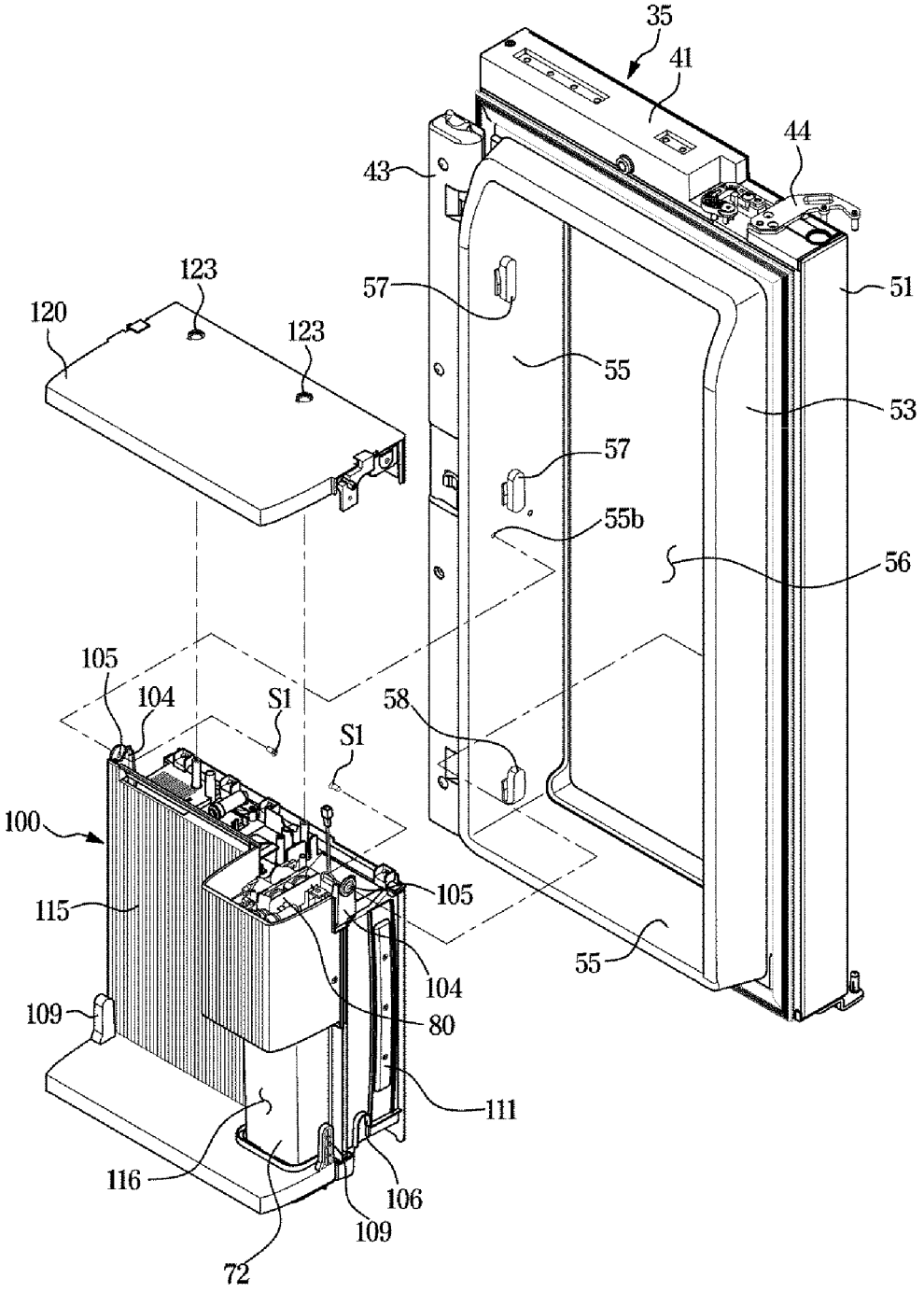
FIG. 9 illustrates a structure of coupling between a water supply unit and an inner door of a refrigerator, according to an embodiment of the disclosure.
Figure 10:
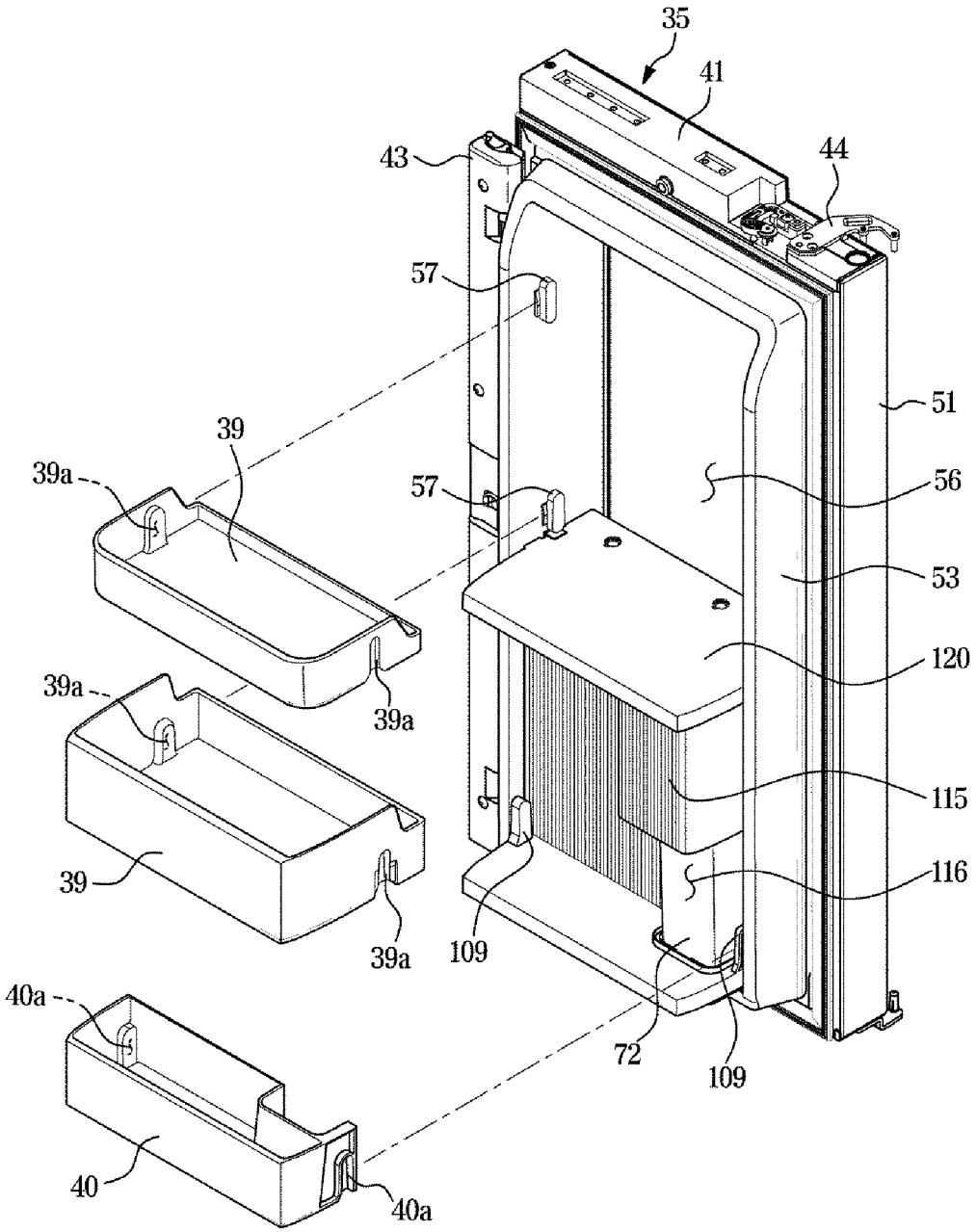
FIG. 10 illustrates a coupling structure of door baskets of a refrigerator, according to an embodiment of the disclosure.
Figure 11:
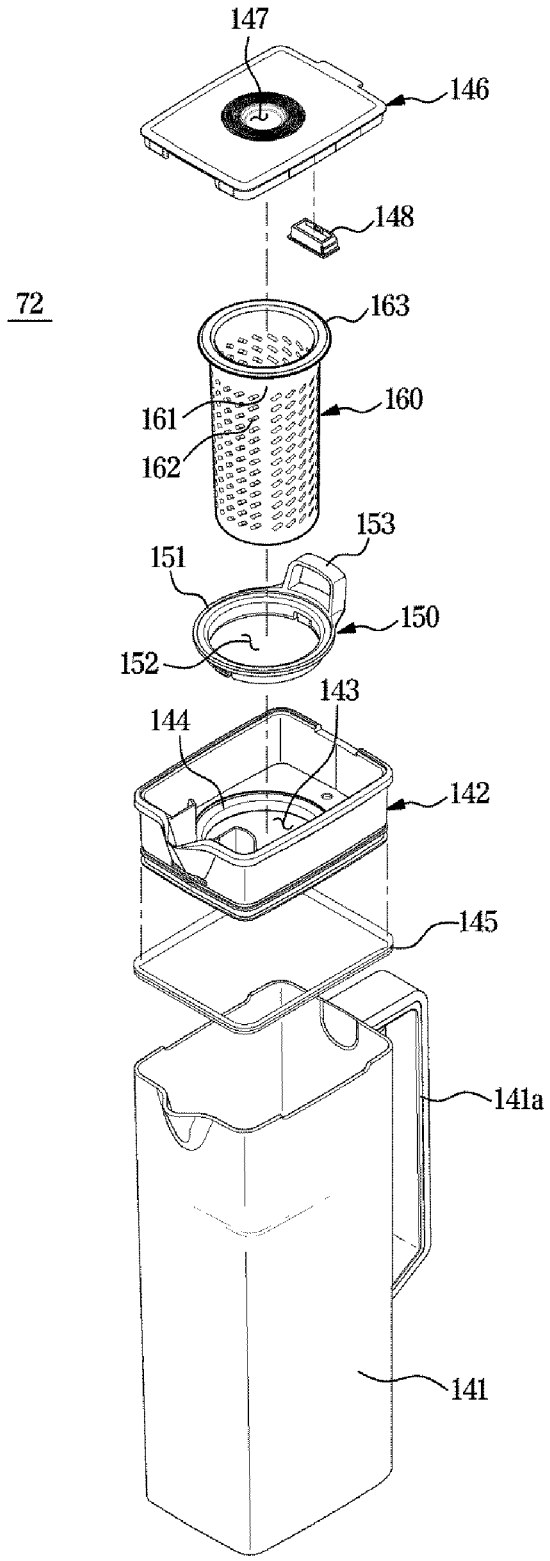
FIG. 11 is an exploded view of a water container of a refrigerator, according to an embodiment of the disclosure.
Figure 12:
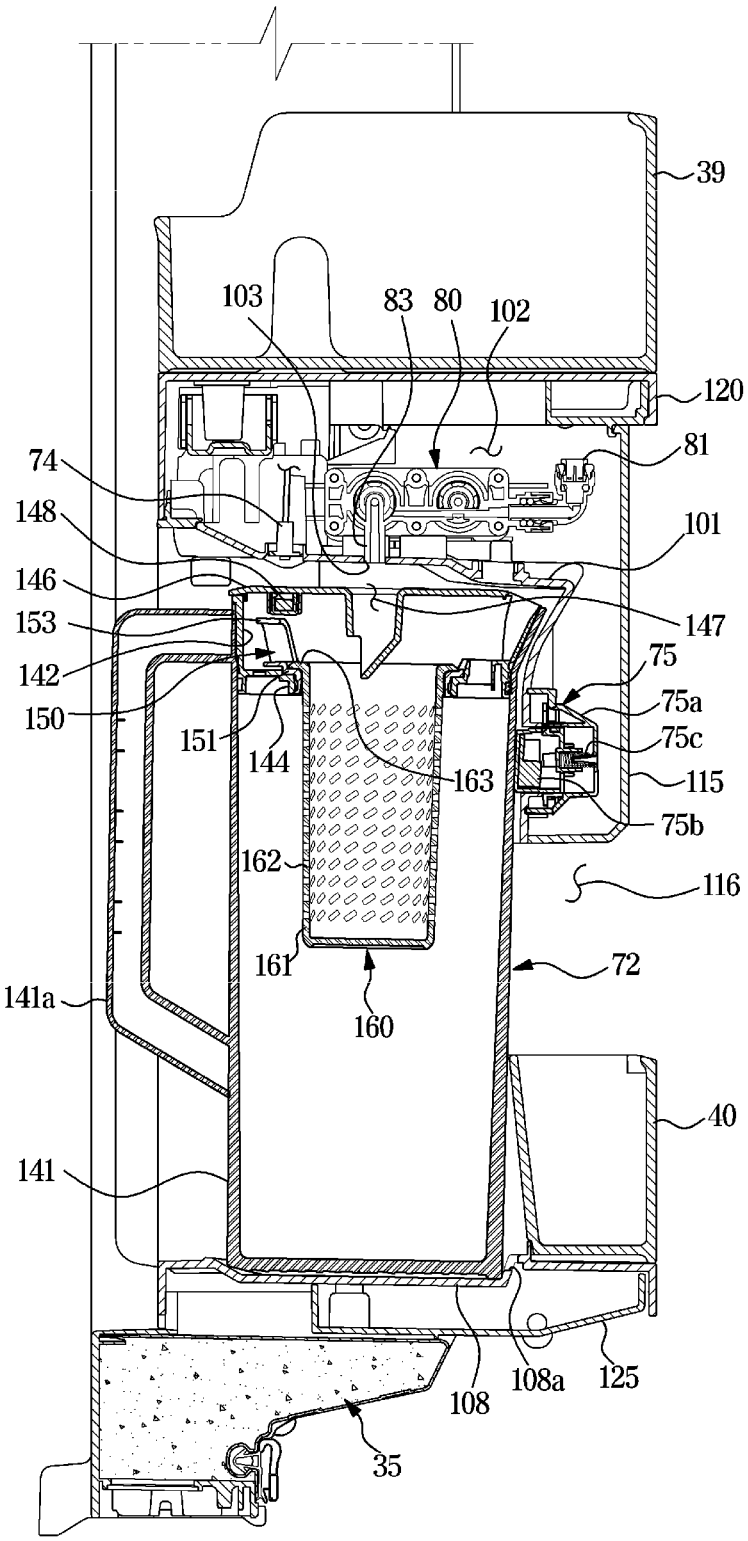
FIG. 12 is a side cross-sectional view of an automatic water supplier of a refrigerator with a water container attached thereto, according to an embodiment of the disclosure.
Figure 13:
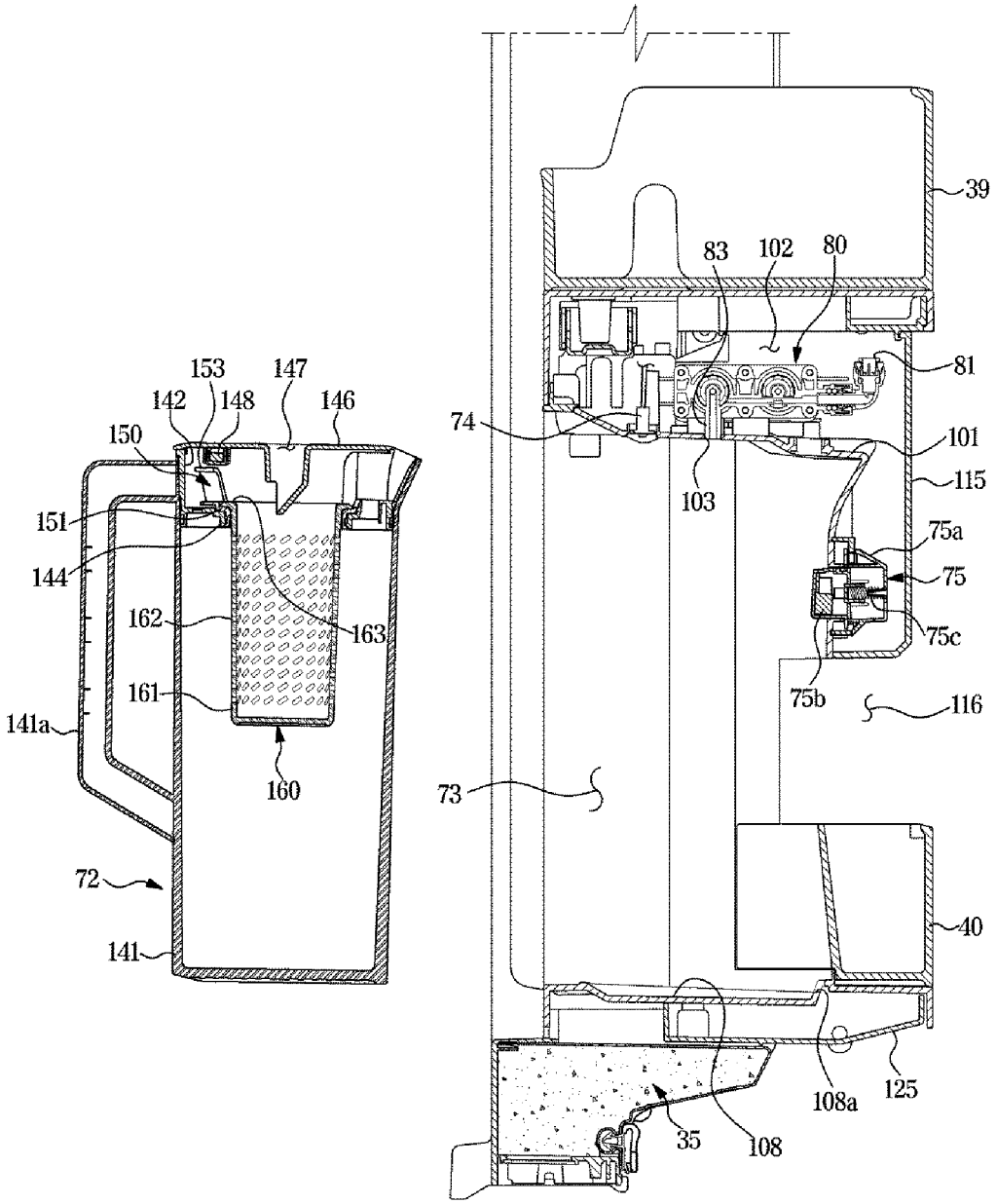
FIG. 13 is a side cross-sectional view of an automatic water supplier of a refrigerator with a water container detached therefrom, according to an embodiment of the disclosure.
Figure 14:
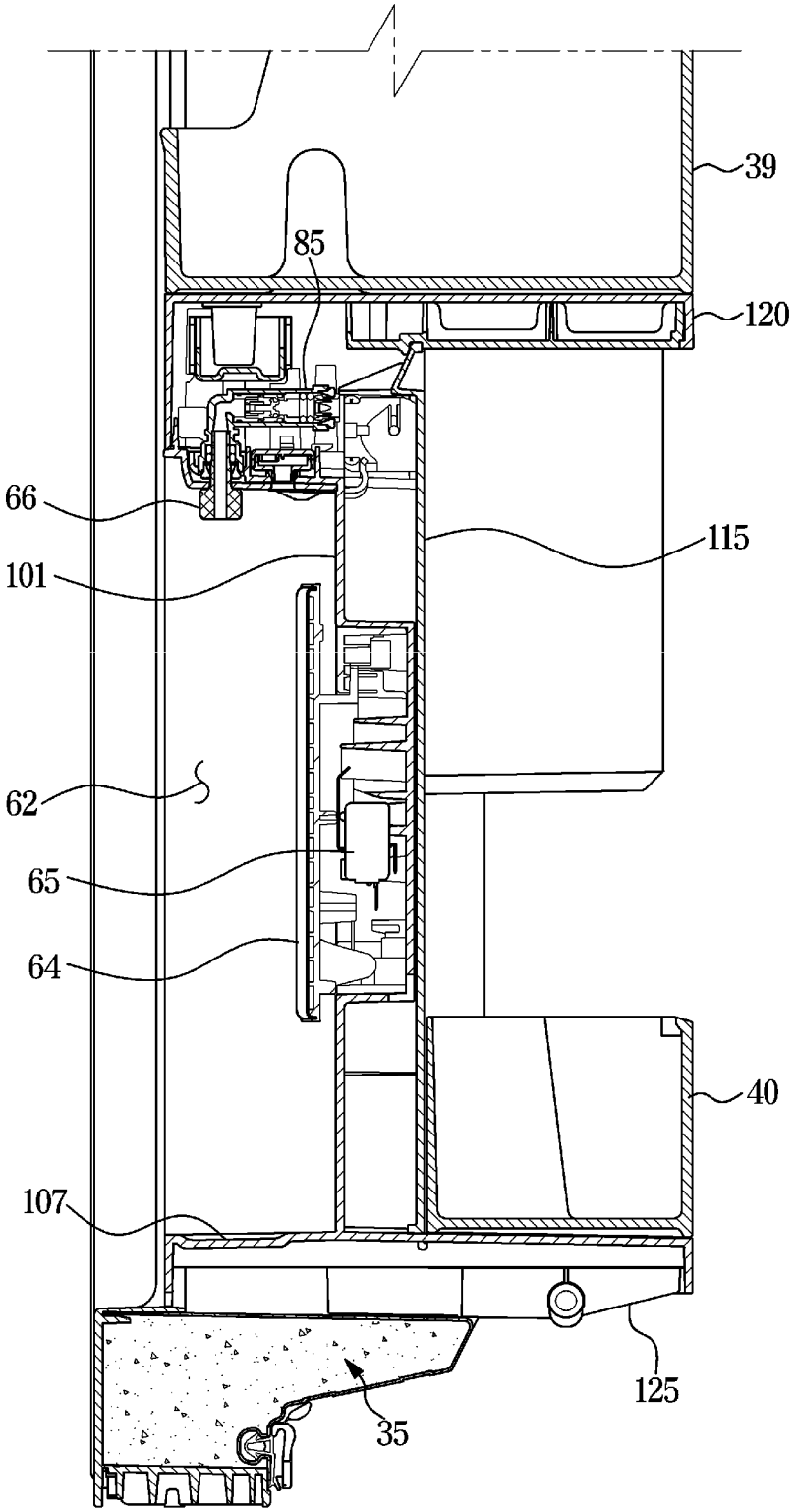
FIG. 14 is a side cross-sectional view of a dispenser of a refrigerator, according to an embodiment of the disclosure.
Figure 18:
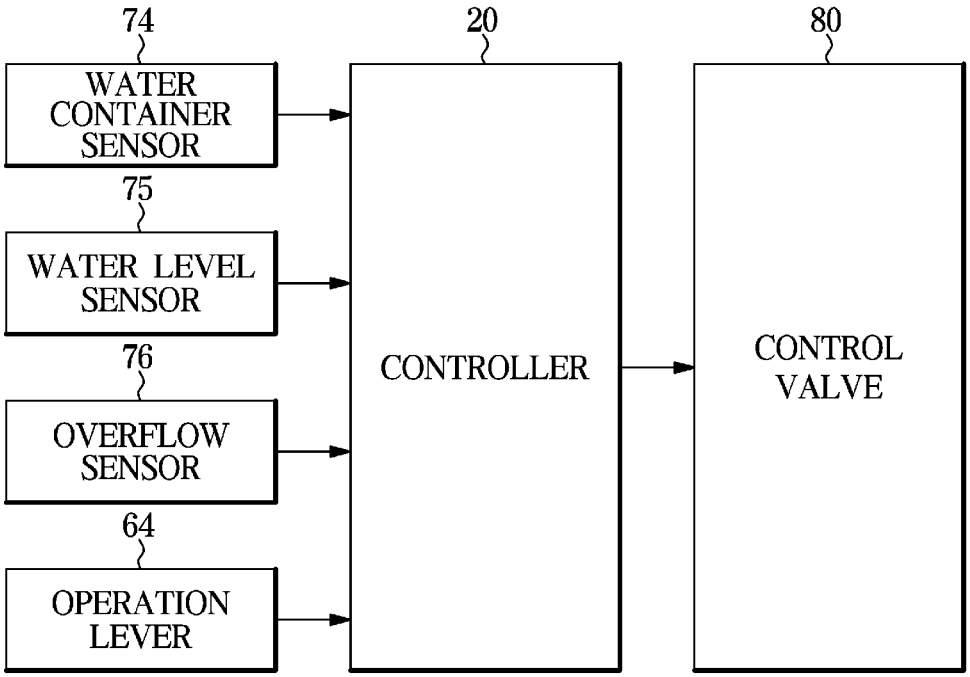
FIG. 18 is a control block diagram of a refrigerator, according to an embodiment of the disclosure.
Figure 19:
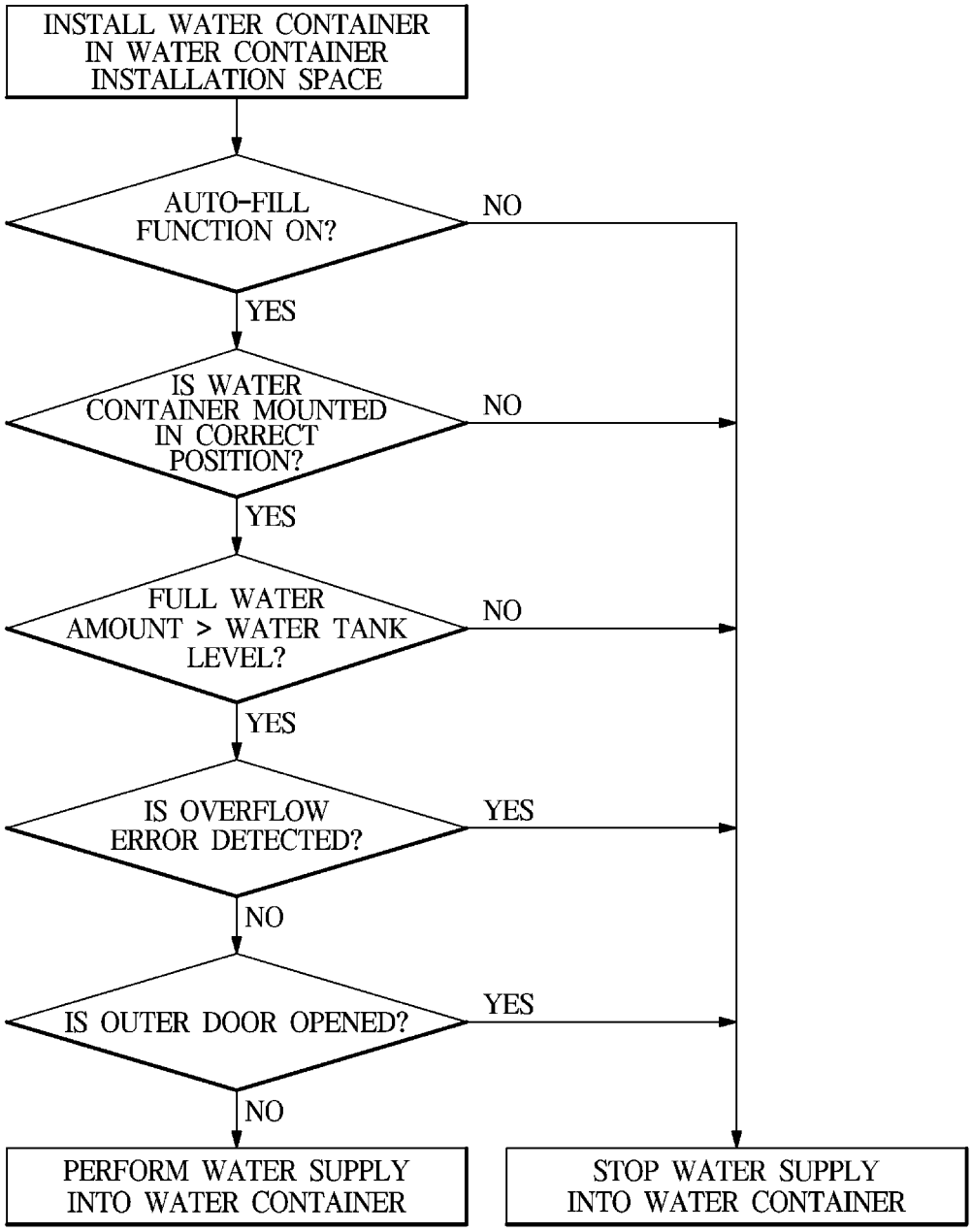
FIG. 19 is a flowchart illustrating a method of controlling water supply of a refrigerator, according to an embodiment of the disclosure.

FIG. 5 illustrates an outer door and an inner door of a refrigerator, according to an embodiment of the disclosure. FIG. 6 is an exploded view of an inner door of a refrigerator, according to an embodiment of the disclosure. FIG. 7 illustrates a flow path structure of a water supply case of a refrigerator, according to an embodiment of the disclosure. FIG. 8 is an exploded view of a water supply unit of a refrigerator, according to an embodiment of the disclosure. FIG. 9 illustrates a structure of coupling between a water supply unit and an inner door of a refrigerator, according to an embodiment of the disclosure. FIG. 10 illustrates a coupling structure of door baskets of a refrigerator, according to an embodiment of the disclosure. FIG. 11 is an exploded view of a water container of a refrigerator, according to an embodiment of the disclosure. FIG. 12 is a side cross-sectional view of an automatic water supplier of a refrigerator with a water container attached thereto, according to an embodiment of the disclosure. FIG. 13 is a side cross-sectional view of an automatic water supplier of a refrigerator with a water container detached therefrom, according to an embodiment of the disclosure. FIG. 14 is a side cross-sectional view of a dispenser of a refrigerator, according to an embodiment of the disclosure. FIG. 18 is a control block diagram of a refrigerator, according to an embodiment of the disclosure. FIG. 19 is a flowchart illustrating a method of controlling water supply of a refrigerator, according to an embodiment of the disclosure.

Referring to FIGS. 5 to 10, the inner door 35 may include a front plate 51, a rear plate 53, an upper cap 41, and a lower cap 42. A foaming space may be formed between the front plate 51, the rear plate 53, the upper cap 41, and the lower cap 42, and insulation (not shown) may be arranged in the foaming space. Urethane foam insulation may be used for the insulation. In addition, for the insulation, vacuum insulation may also be used with the foam insulation.

The front panel 51 may form the front and both sides of the inner door 35. The front panel 51 may include a front panel opening 51*a* corresponding to the front panel 51 except for edge portions.

The catch 59 may be arranged on the front panel 51 to interlock with the latch 37 of the outer door 36.

The rear panel 53 may include the door-inside space 56 formed in the middle of the rear plate 53 except for edge portions. The rear panel 53 may include door-inner sides 55 that define the door-inside space 56. The door-inner sides 55 may be formed on top, bottom, left and right sides of the door-inside space 56 to define the door-inside space 56. However, unlike this embodiment of the disclosure, the door-inner sides 55 may be formed by the front panel 51 or may be formed by both the front panel 51 and the rear panel 53.

First door beads 57 may be formed on the door-inner side 55 to protrude from the door-inner side 55 toward the door-inside space 56 in order for the door basket 39 to be mounted. The door basket 39 may be mounted on the door-inner sides 55 through the first door beads 57.

A second door bead 58 may be formed on the door-inner side 55 to protrude from the door-inner side 55 toward the door-inside space 56 in order for the water supply case 100 to be mounted. The water supply case 100 may be mounted on the door-inner sides 55 through the second door bead 58. A fastening hole 55*b* may be formed on the door-inner side 55 for the water supply unit 60 to be coupled through a fastening member Si (see FIG. 9).

A through-port 55*a* through which wires and hoses connected to the water supply unit 60 pass may be formed on the door-inner side 55. The water supply flow path 97 passing through a hinge shaft on the top of the inner door 35 and then inserted to the inner door 35 may be guided to the water supply case 100 through a flow path guide 97*a* (see FIG. 6) and the through-port 55*a*.

Referring to FIG. 8, the water supply case 100 may include a main case 101, a rear case 115 coupled onto the back of the main case 101, a case cover 120 coupled onto the top of the main case 101, and a tray 125 coupled to the bottom of the main case 101.

The water-intake space 62 and the water container installation space 73 may be formed on the front of the main case 101. The water-intake space 62 and the water container installation space 73 may be formed side by side in the horizontal direction. The water-intake space 62 and the water container installation space 73 may be connected to each other.

On the bottom of the main case 101, there may be a container pedestal 107 to support a container that receives water discharged into the intake space 62, and a water container pedestal 108 to support the water container 72 that receives water discharged through the automatic water supplier 71.

The main case 101 may include a lever installation part 110 in which the operation lever 64 of the dispenser 61 is mounted, and a switch 65 that is turned on or off depending on the position of the operation lever 64 may be arranged in the lever installation part 110.

A reinforcing member 111 may be coupled onto either side of the main case 101 to prevent shrinkage deformation of the main case 101 due to cooling. The reinforcing member 111 may be formed of an iron plate material. The reinforcing member 111 may be arranged vertically to be long on either side of the main case 101.

A valve installation space 102 (see FIG. 8) may be formed on the top side of the main case 101. The control valve 80 may be mounted in the valve installation space 102, and the case cover 120 coupled onto the top of the main case 101 may prevent the control valve 80 from being exposed to the outside. That is, the valve installation space 102 may be formed between the main case 101 and the case cover 120. The case cover 120 may be coupled onto the top of the main case 101 through a fastening member such as a screw. For this, a coupling hole 123 may be formed at the case cover 120 to be coupled with the fastening member.

The control valve 80 may guide water supplied from the external water source 90 through the water supply flow path 97 to the water-intake space 62 or the water container 72. The control valve 80 may be shaped like a three-way valve. Specifically, the control valve 80 may include an inflow port 81 connected to the water supply flow path 97 to receive water from the external water source 90, a first outflow port 82 for supplying water toward the water-intake space 62, and a second out-flow port 83 for supplying water toward the water container 72. The first and second outflow ports 82 and 83 may be selectively opened or closed.

Referring to FIG. 7, the water supply flow path 97 guided into the water supply case 100 through the through-port 55*a* may be connected to one end of a first fitting member 84. The other end of the first fitting member 84 and the inflow port 81 of the control valve 80 may be connected by a connection flow path 98. However, unlike this embodiment of the disclosure, the first fitting member 84 may be omitted and the water supply flow path 87 may be directly connected to the inflow port 81 of toe control valve 80.

The first outflow port 82 of the control valve 80 may be connected to one end of a second fitting member 85 arranged on the top side of the main case 101 through a second connection flow path 99. The other end of the second fitting member 85 may be coupled to the dispenser nozzle 66. The dispenser nozzle 66 may be detachably coupled to the other end of the second fitting member 85.

The second outflow port 83 may be formed to protrude downward from the control valve 80. The second outflow port 83 may be placed in a valve through-hole 103 formed at the top side of the main case 101. The water discharged from the second outflow port 83 may fall in a direction of gravity and flow directly into an inlet 147 of the water container 72 without an extra connection member (see FIG. 12). Accordingly, as described above, the second outflow port 83 may be referred to as an outlet of the automatic water supplier 71.

The refrigerator 1 may include a water container sensor 74 for detecting whether the water container 72 is mounted in the water container installation space 73. The control valve 80 may be configured to block water from being supplied into the water container 72 when the water container sensor 74 detects that the water container 72 has not been mounted in the water container installation space 73. In other words, the control valve 80 may be configured to allow water to be supplied into the water container 72 when the water container 72 is mounted in the water container installation space 73.

The control valve 80 may be configured to block water from being supplied into the water container 72 when the water level sensor 75 detects that a certain amount of water has been stored in the water container 72. On the other hand, the control valve 80 may be configured to allow water to be supplied into the water container 72 when the water level sensor 75 detects that the certain amount of water has not been stored in the water container 72. That is, the control valve 80 may be configured to open or close the second outflow port 83 based on the water level in the water container 72 detected by the water level sensor 75.

The control valve 80 may be configured to block water from being supplied into the water container 72 when an overflow sensor 76 detects that a certain amount of water has been collected in the tray 125.

The control valve 80 may open the first outflow port 82 that supplies water toward the water-intake space 62 when a certain signal is input to the operation lever 64.

The tray 125 may be arranged underneath the main case 101. The tray 125 may store water flowing out of the water container 72 mounted in the water container installation space 73. Specifically, the tray 125 may collect water overflowing from the water container 72 when water is overly supplied into the water container 72 and overflows out of the water container 72.

When the water overflows from the water container 72, the water overflowing from the water container 72 may be guided to the tray 125 through an overflow hole 108*a* of the main case 101.

The overflow sensor 76 may be arranged at the tray 125 to detect water collected in the tray 125. When detecting that a certain amount of water has been collected in the tray 125, the overflow sensor 76 may send the controller 20 a signal to control the control valve 80 to block water from being supplied into the water container 72.

A drain hole 126 may be formed at the tray 125 to drain out the water collected in the tray 125. A stopper 127 may be mounted in the drain hole 126 to open or close the drain hole 126. The stopper 127 may be provided to close the drain hole 126 in ordinary times, and when the stopper 127 is detached from the drain hole 126, the water collected in the tray 125 may be discharged to the outside.

The water container sensor 74 may be arranged on the top of the main case 101 to detect whether the water container 72 is mounted. The water container sensor 74 may be configured with a hall sensor. The water container sensor 74 may detect a magnet 148 (see FIG. 12) equipped in the water container 72. The water container sensor 74 may be covered by the case cover 120 and may not be exposed to the outside.

The water container sensor 74 may detect whether the water container 72 is mounted in the water container installation space 73 of the water supply case 100, and send the controller 20 a signal to control the control valve 80 to block water from being supplied into the water container 72 when the water container 72 is not mounted. Accordingly, water may be prevented from being supplied into the water container 72 while the water container 72 is not properly mounted.

As described above, the main case 101 may be arranged in the door-inside space 56 of the inner door 35. Specifically, the main case 101 may be coupled onto the door-inner sides 55 that define the door-inside space 56. For this, a bead groove 106 may be formed on either side of the main case 101. The man case 101 may be arranged in the door-inside space 56 of the inner door 35 in such a manner that the second door bead 58 of the inner door 35 is inserted to the bead groove 106.

In order for the main case 101 to be securely coupled to the door-inside space 56 of the inner door 35, the main case 101 may be coupled to the inner door 35 through the fastening member 51 such as a screw. For this, a coupling hole 105 to be coupled with the fastening member 51 may be arranged at the main case 101, and a fastening hole 55*b* to be coupled with the fastening member 51 may be formed at the door-inner side 55 of the inner door 35. The main case 101 may include a coupling bracket 104 that protrudes upward, and the coupling hole 105 may be formed at the coupling bracket 104.

With this structure, the main case 101 may be coupled with the inner door 35 in such a manner that the second door bead 58 of the inner door 35 is inserted to the bead groove 106 of the main case 101 and then the fastening member 51 is fastened to the coupling hole 105 of the main case 101 and the fastening hole 55*b* of the inner door 35. On the contrary, the main case 101 may be separated from the inner door 35 by separating the fastening member 51 and decoupling the second door bead 58 from the bead groove 106.

The water supply case 100 may include a rear case 115 to be coupled to the back of the main case 101. The rear case 115 may define a rear appearance of the water supply unit 60. The rear case 115 may include a cut portion 116 formed by cutting a portion of the rear case 115 located behind the water container installation space 73. At least one side of the water container 72 mounted in the water container installation space 73 may be exposed through the cut portion 116. Hence, the water container 72 may be easily cooled by cold air of the storeroom 21.

The water level sensor 75 may be arranged between the main case 101 and the rear case 115.

The water level sensor 75 may be coupled to the rear surface of the main case 101. The position of the water level sensor 75 is not, however, limited thereto, and the water level sensor 75 may be arranged in any position that allows detection of the water level in the water container 72.

The water level sensor 75 may correspond to a capacitance sensor capable of detecting the water level in the water container 72 by detecting capacitance that changes by water level in the water container 72. The water level sensor 75 is able to detect the water level in the water container 72 without directly contacting a liquid in the water container 72, thereby having a relatively simple configuration and obtaining a relatively accurate detection result.

The water level sensor 75 may detect the water level in the water container 72 while in contact with the water container 72. For this, the water level sensor 75 may include a sensor bracket 75*a* fixed to the main case 101, a sensor part 75*b* for detecting the water level in the water container 72, and an elastic member 75*c* for pressing the sensor part 75*b* against the water container 72.

The sensor part 75*b* may be arranged to come into contact with the water container 72 when the water container 72 is mounted in the water container installation space 73. The sensor part 75*b* may be arranged to be movable forward or backward relative to the sensor bracket 75*a*.

When a certain amount of water is stored in the water container 72, the water level sensor 75 may send the controller 20 a signal to control the control valve 80 to block water from being supplied into the water container 72. On the other hand, when the water container 72 is filled with less than the certain amount of water, the water level sensor 75 may send the controller 20 a signal to control the control valve 80 to perform water supply into the water container 72.

Referring to FIG. 10, the door baskets 39 and 40 may include the door basket 39 mounted on the first door bead 57 of the inner door 35 and the door basket 40 mounted on the case bead 109 of the water supply case 100.

A bead groove 39*a* may be formed at either side of the door basket 39, and the door basket 39 may be mounted at the inner door 35 by inserting the first door bead 57 to the bead groove 39*a*.

A bead groove 40*a* may be formed at either side of the door basket 40, and the door basket 40 may be mounted at the water supply case 100 by inserting the case bead 109 of the water supply case 100 to the bead groove 40*a*.

Referring to FIG. 11, the water container 72 may include a water container body 141 for storing water, a water container middle cover 142 coupled onto the top of the water container body 141, a water container top cover 146 coupled onto the top of the water container middle cover 142, an infuser 160 for containing e.g., a tea bag, and an infuser ring 150 for easily attaching or detaching the infuser 160 to or from the water container middle cover 142.

The water container body 141 may store a certain amount of water. A maximum amount of water to be stored in the water container body 141 may be called a full water amount. The water container body 141 may be formed with a transparent material for the water stored inside to be checked. The water container body 141 may include a water container handle 141*a* formed for the user to easily grip to mount or demount the water container body 141 in or from the water container installation space 73.

The water container middle cover 142 may be coupled with the water container body 141 by forced fitting. The water container middle cover 142 may include a cover opening 143 to which the infuser 160 is inserted. A ring supporter 144 may be formed around the cover opening 143 for a ring part 151 of the infuser ring 150 to be seated thereon. The water container middle cover 142 may have open top for the infuser 160 to be easily mounted.

A sealing member 145 may be arranged between the water container body 141 and the water container middle cover 142 to prevent a leak of the water stored in the water container body 141. The sealing member 145 may be formed of an elastic material such as rubber.

The water container top cover 146 may be provided to cover the open top of the water container middle cover 142. The water container top cover 146 may include an inlet 147 through which water flows into the water container body 141. When the water container 72 is mounted in the water container installation space 73, the inlet 147 may be positioned to match the valve through-hole 103 formed at the top of the main case 101 and the second outflow port 83 of the control valve 80 (see FIG. 11).

A magnet 148 may be arranged at the water container top cover 146. The magnet 148 may be arranged in a position matching the water container sensor 74 when the water container 72 is mounted in the water container installation space 73.

The infuser 160 may include a filter 161 formed to contain e.g., a tea bag. The filter 161 may have a circular form. Through holes 162 may be formed at the filter 161 to pass water through the filter 161. A rim 163 may be formed at the top end of the filter 161 to protrude outward in the radial direction.

The infuser ring 150 may include a ring part 151 having a ring opening 152 to which the infuser 160 is inserted, and a ring handle 153 protruding from the ring part 151. When the infuser 150 is inserted down to the ring opening 162 of the infuser ring 150, the lower side of the rim 163 of the infuser 160 may be seated on the top surface of the ring part 151.

The infuser 160 may be mounted in the water container 72 by holding the ring handle 153 of the infuser ring 150 while the infuser 160 is seated on the infuser ring 150 and then setting the lower side of the ring part 151 of the infuser ring 150 safely on the ring supporter 144 of the water container middle cover 142. The infuser 160 may be easily separated from the water container 72 by holding the ring handle 153 of the infuser ring 150 to separate the infuser 160 from the water container 72.

In the meantime, water supply into the water container 72 of the automatic water supplier 71 may be controlled depending on opening or closing the outer door 36. Specifically, the automatic water supplier 71 may be controlled to perform water supply into the water container 72 when the outer door 36 is closed, and not to perform water supply into the water container 72 when the outer door 36 is opened.

When the outer door 36 is opened while the water is supplied, the water supply may be terminated. When the outer door 36 is closed again after the water supply is terminated, water supply may be continued until a certain amount of water is filled in the water container 72.

After the certain amount of water is filled in the water container 72, the automatic water supplier 71 may stop supplying water into the water container 72 before the water container 72 is separated from the water container installation space 73. This is because the water in the water container 72 is less likely to shrink when the water container 72 remains being mounted in the water container installation space 73.

Furthermore, the automatic water supplier 71 may be controlled through the control panel 25 to perform or not to perform an operation. Specifically, the control panel 25 may be equipped with an on button (not shown) to receive a user command to activate the automatic water supplier 71 and an off button (not shown) to receive a user command to deactivate the automatic water supplier 71.

When the automatic water supplier 71 is activated by the user touching the on button, the aforementioned operation of the automatic water supplier 71 may be performed.

When the automatic water supplier 71 is deactivated by the user touching the off button, the automatic water supplier 71 may not supply water into the water container 72 even when the water container 72 is mounted in the automatic water supplier 71.

Furthermore, the automatic water supplier 71 may be controlled to supply a certain amount of water into the water container 72 regardless of the water level of the water container 72 (required water supply) instead of being controlled to supply water into the water container 72 until a certain amount of water is filled in the water container 72 (auto-fill). In this case, the control panel 25 may be equipped with an extra button for required water supply (not shown) in addition to the on button and the off button.

When the required water supply function is activated by the user touching the button for required water supply, the automatic water supplier 71 may supply the certain amount of water into the water container 72 regardless of the water level in the water container 72.

Figure 15:
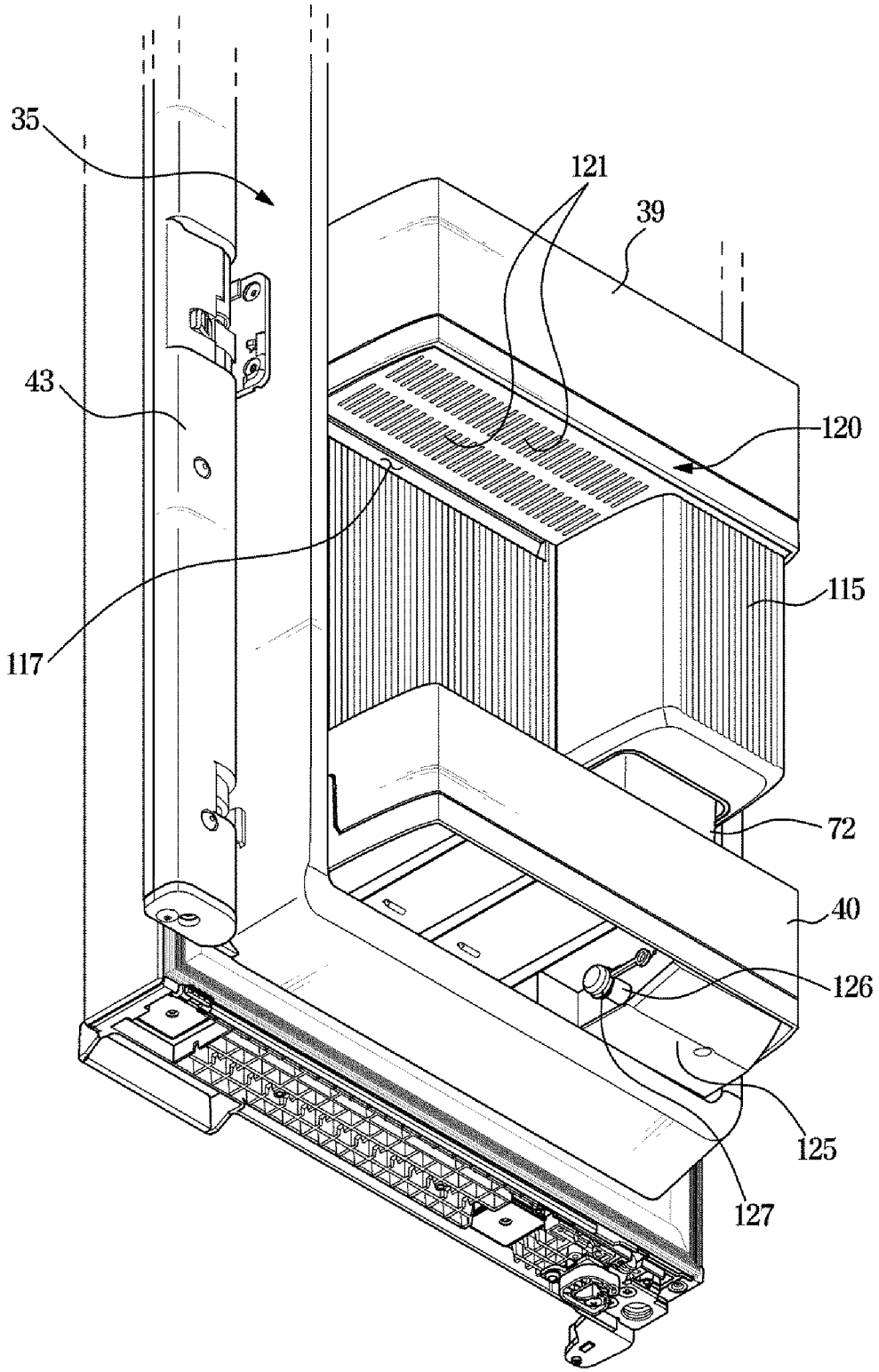
FIG. 15 is a perspective view of a rear side of an inner door of a refrigerator, according to an embodiment of the disclosure.
Figure 16:
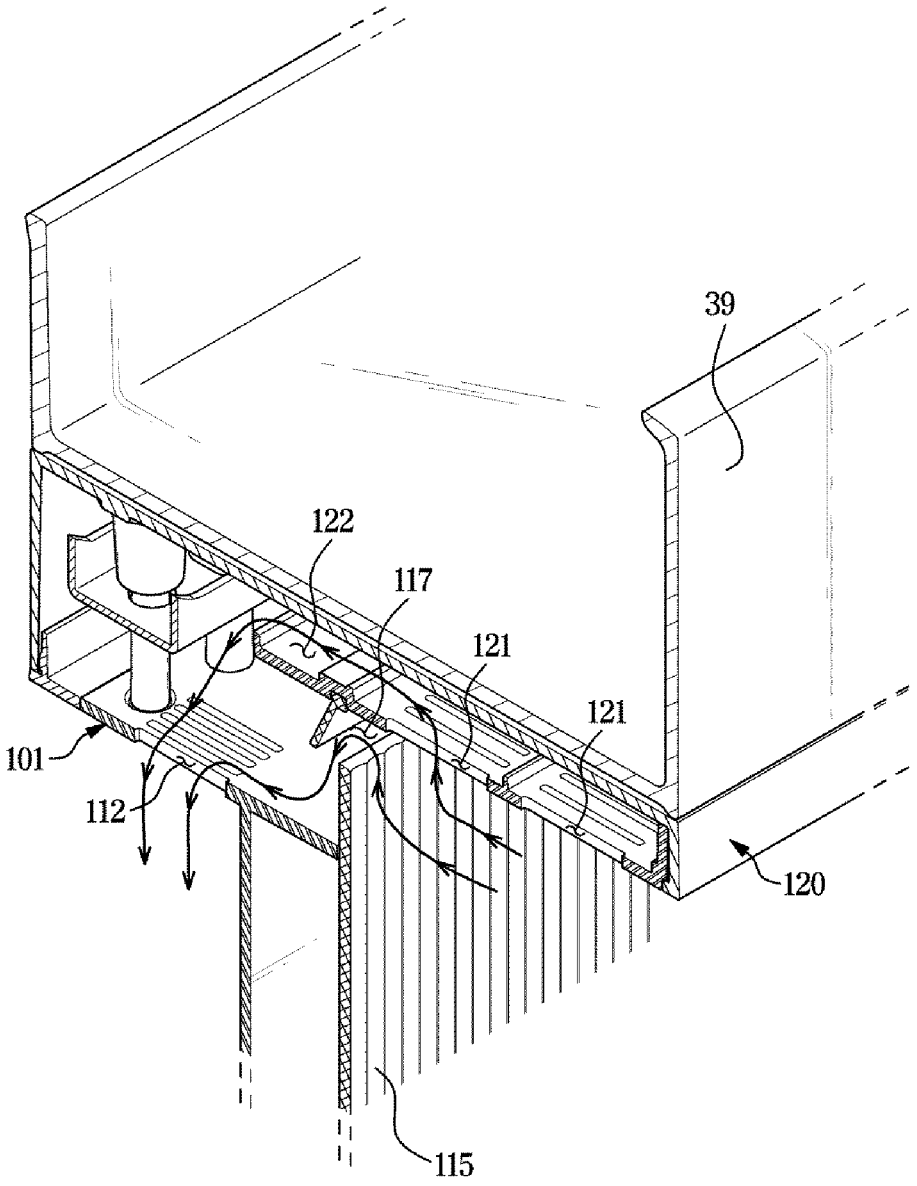
FIG. 16 is a cross-sectional view of a water supply case illustrating flows of cold air of a refrigerator, according to an embodiment of the disclosure.
Figure 17:
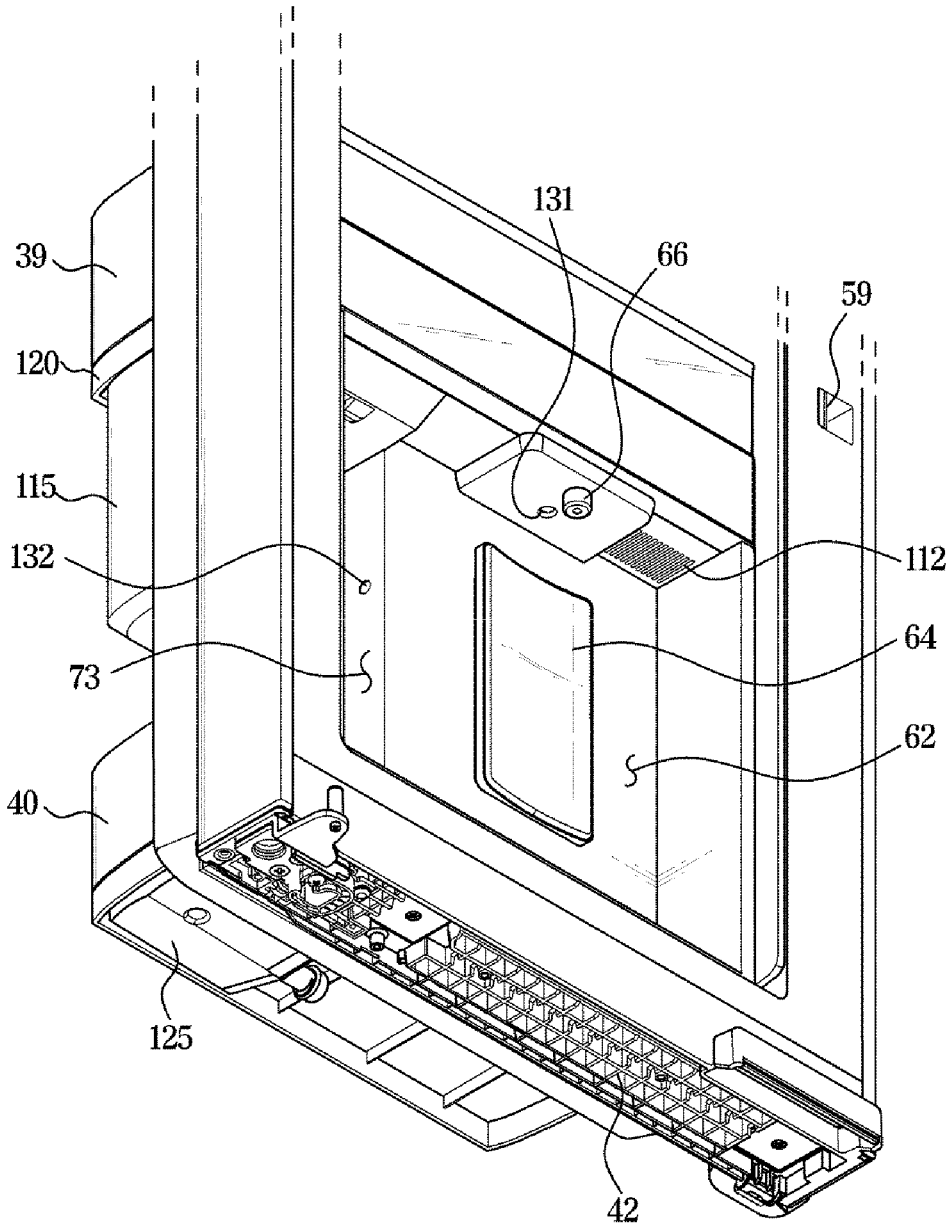
FIG. 17 is a perspective front view of an inner door of a refrigerator, according to an embodiment of the disclosure.

FIG. 15 is a perspective view of a rear side of an inner door of a refrigerator, according to an embodiment of the disclosure. FIG. 16 is a cross-sectional view of a water supply case illustrating flows of cold air of a refrigerator, according to an embodiment of the disclosure. FIG. 17 is a perspective front view of an inner door of a refrigerator, according to an embodiment of the disclosure.

Referring to FIGS. 15 to 17, the water supply case 100 may include cold air holes formed to easily supply cold air of the storeroom 21 into the water-intake space 62 and the water container installation space 73 formed on the front of the water supply case 100.

The cold air holes may include a first cold air hole 121 formed at the case cover 120 and a second cold air hole 112 formed at the main case 101.

The cold air flowing into an inner space 122 between the case cover 120 and the main case 101 through the first cold air hole 121 may be guided to the water-intake space 62 and the water container installation space 73.

The cold air holes may include a third cold air hole 117 formed between the case cover 120 and the rear case 115. The cold air flowing into the inner space 122 between the case cover 120 and the main case 101 through the third cold air hole 117 may be guided to the water-intake space 62 and the water container installation space 73.

As the cold air of the storeroom 21 is easily supplied to the water-intake space 62 and the water container installation space 73 through those cold air holes, the water container 72 mounted in the water container installation space 73 may be efficiently cooled.

Lamps 131 and 132 may be provided at the water supply case 100. The first lamp 131 may be arranged in an upper portion of the water-intake space 62 to illuminate the operation lever 64. The second lamp 132 may be arranged on a side of the water container installation space 73 to illuminate the water container 72. The first and second lamps 131 and 132 may be arranged to be turned on or off in connection with opening or closing the outer door 36.

Figure 20:
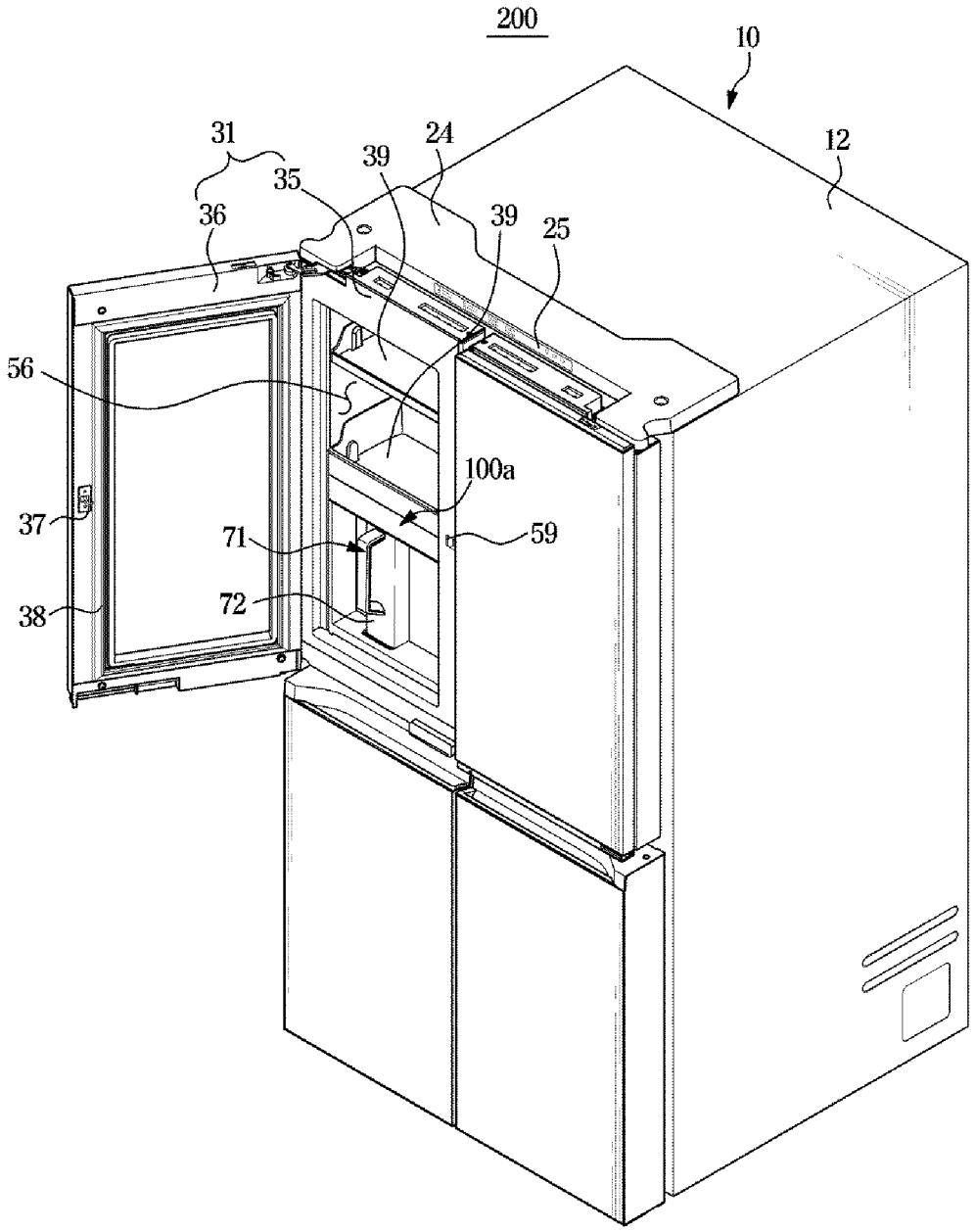
FIG. 20 illustrates a refrigerator with an outer door open, according to another embodiment of the disclosure.
Figure 21:
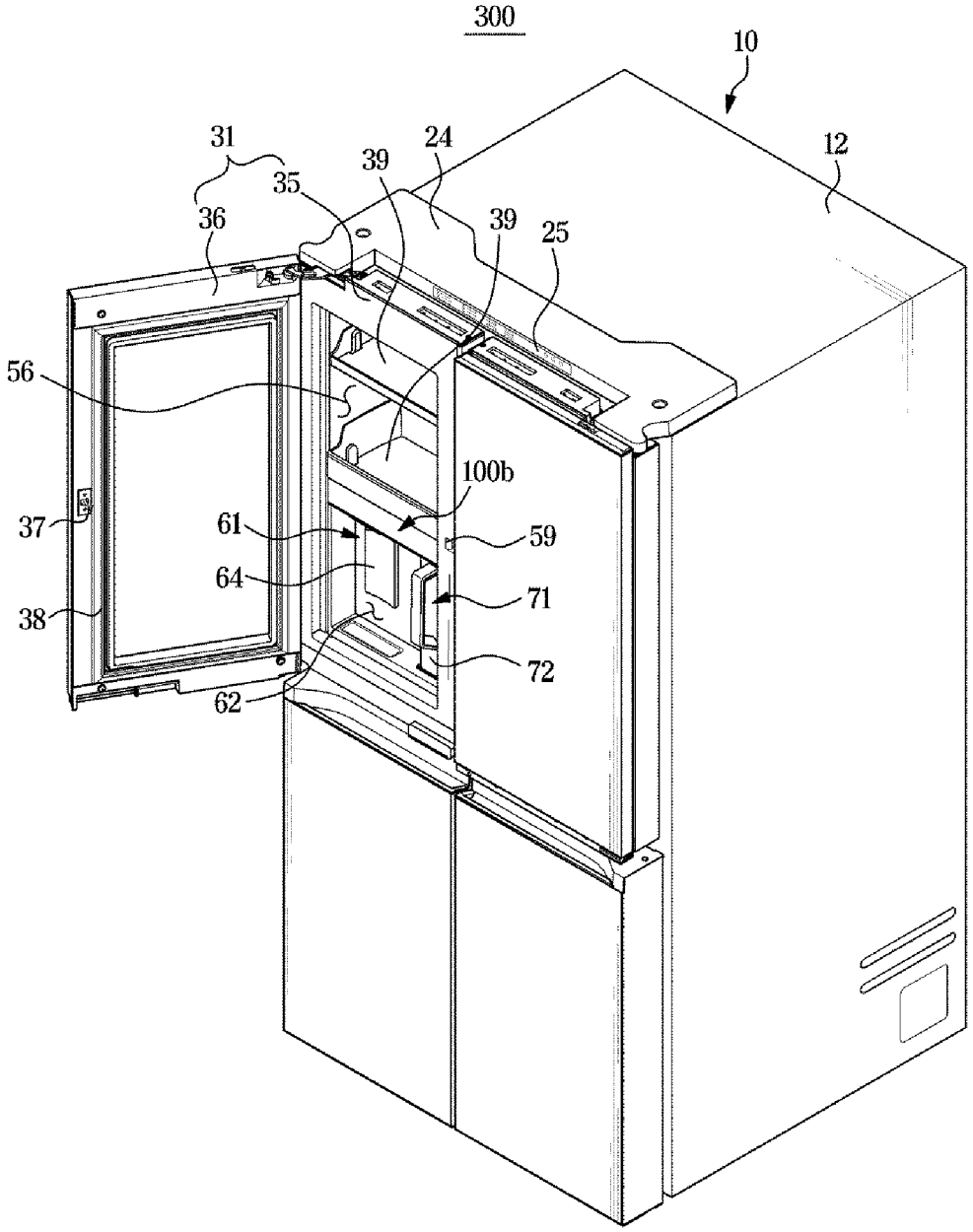
FIG. 21 illustrates a refrigerator with an outer door open, according to another embodiment of the disclosure.
Figure 22:
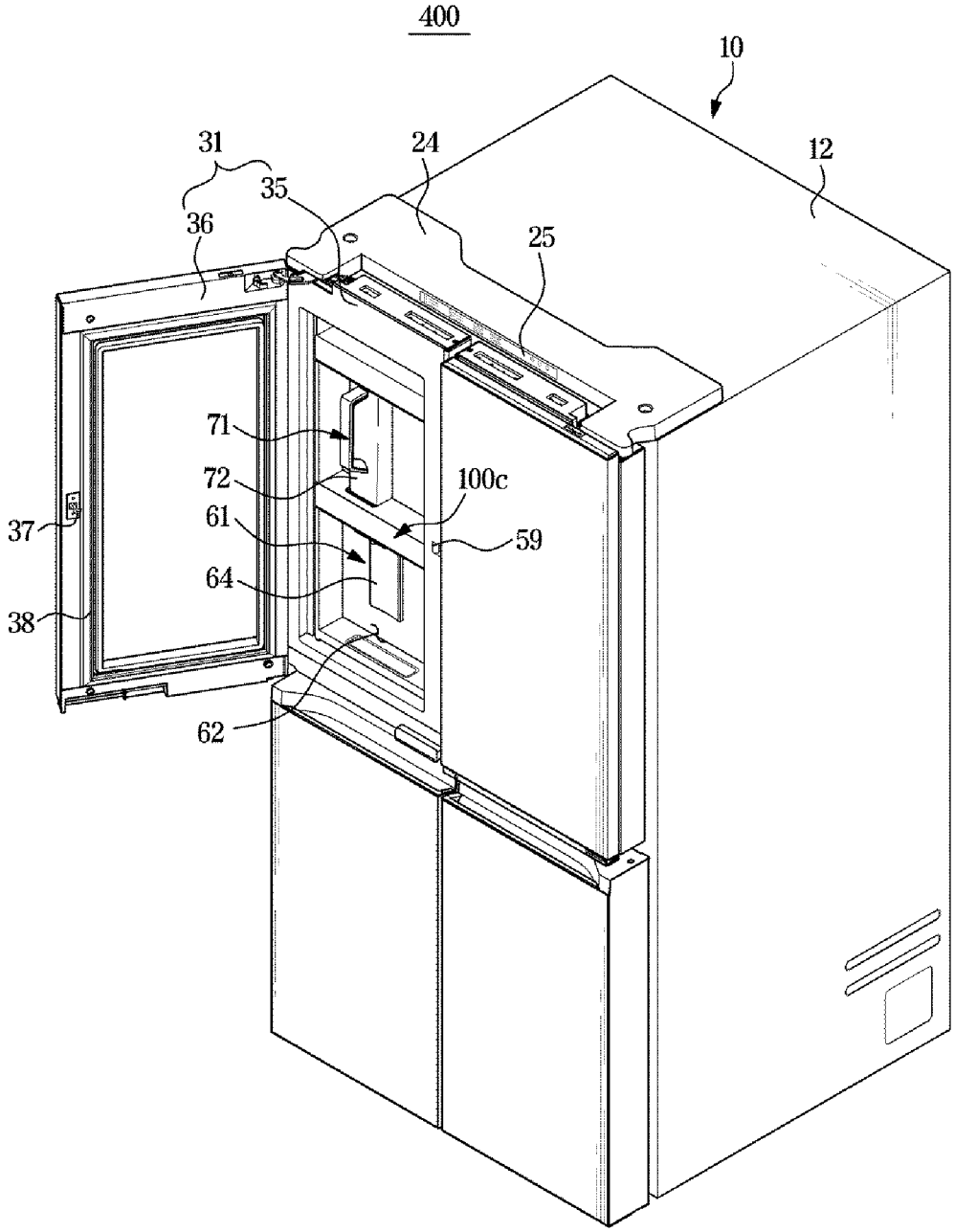
FIG. 22 illustrates a refrigerator with an outer door open, according to another embodiment of the disclosure.
Figure 23:
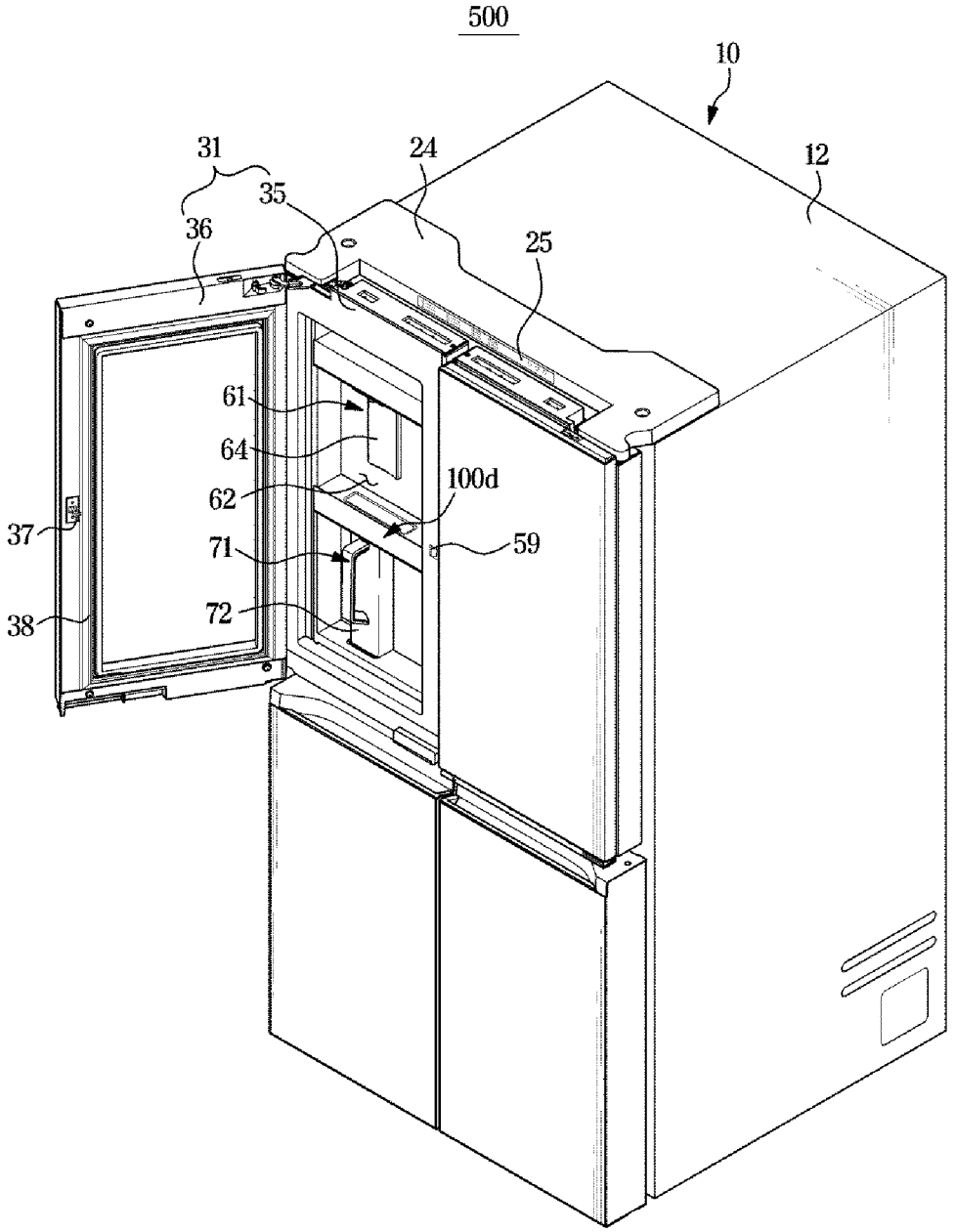
FIG. 23 illustrates a refrigerator with an outer door open, according to another embodiment of the disclosure.

FIG. 20 illustrates a refrigerator 200 with an outer door open, according to another embodiment of the disclosure. FIG. 21 illustrates a refrigerator 300 with an outer door open, according to another embodiment of the disclosure. FIG. 22 illustrates a refrigerator 400 with an outer door open, according to another embodiment of the disclosure. FIG. 23 illustrates a refrigerator 500 with an outer door open, according to another embodiment of the disclosure.

The same features as in the aforementioned embodiment are denoted by the same reference numerals, and the overlapping description will not be repeated.

As shown in FIG. 20, it is also possible to omit the dispenser from the refrigerator as described above in the previous embodiment of the disclosure. In this case, the control valve may be a two-way valve instead of the three-way valve, and the flow path for guiding water from the water supply flow path to the dispenser may also be omitted.

As shown in FIG. 20, positions of the dispenser and the automatic water supplier as described above in the previous embodiment of the disclosure may be reversed.

As shown in FIGS. 22 and 23, the dispenser and the automatic water supplier as described above in the previous embodiment of the disclosure may be arranged not horizontally but vertically. The automatic water supplier may be arranged on the top of the dispenser or the dispenser may be arranged on the top of the automatic water supplier. In this case, the door guard arranged on the automatic water supplier and the dispenser, as described above in the previous embodiment of the disclosure, may be omitted.

In the embodiments of FIGS. 20 to 23, internal parts of water supply cases 100*a*, 100*b*, 100*c* and 100*d* may be omitted or changed depending on whether the dispenser is omitted or positions of the dispenser and the automatic water supplier.

According to various embodiments of the disclosure, the energy loss of a refrigerator may be reduced by eliminating the need to open an inner door when the user accesses a dispenser or an automatic water supply.

According to various embodiments of the disclosure, the user may draw a water container forward from an inner door to take out the water container from an automatic water supplier, thereby improving usability of the refrigerator.

According to various embodiments of the disclosure, a dispenser and an automatic water supplier in a refrigerator may be formed in a single assembly, thereby improving assembling performance, durability, and the design.

According to the disclosure, a robot hand is able to open or close two links on one side and two links on the other side while synchronously operating a link connecting the two links on the one side and a link connecting the two links on the other side.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. A refrigerator comprising:

a main body including a storeroom;

a door including an inner door rotatably arranged in front of the main body to open or close the storeroom, the inner door having door-inner sides which form a door opening, and an outer door rotatably arranged in front of the inner door to open or close the door opening;

a water supply case coupled to a least one of the door-inner sides of the inner door, the water supply case having a water container installation space formed in the water supply case for a water container to be mounted in or dismounted from the water container installation space while the outer door is open and the inner door is closed; and an automatic water supplier including an outlet and a water level sensor for detecting a water level in the water container, the automatic water supplier being configured to supply water through the outlet while the water container is mounted in the water container installation space, and wherein the water supply case comprises a rear portion behind the water container installation space to cover at least a portion of the water container mounted in the water container installation space and a cut portion formed in the rear portion so that the water container mounted in the water container installation space is cooled by cold air of the storeroom.

2. The refrigerator of claim 1, wherein the door-inner sides comprise a top side, a bottom side, a left side of and a right side of the door opening.

3. The refrigerator of claim 2, wherein the water container installation space has an open front side to allow the water container to be mounted in or dismounted from the water container installation space.

4. The refrigerator of claim 3, wherein the water supply case comprises a main case in which the water container installation space is formed; and a rear case couplable to a rear side of the main case and having the cut portion formed in the rear case.

5. The refrigerator of claim 2, wherein the inner door comprises a door bead formed to protrude toward the door opening from at least one of the door-inner sides, and the water supply case comprises a bead groove formed for the door bead to be insertable into the bead groove.

6. The refrigerator of claim 1, further comprising a door basket mountable in the door opening.

7. The refrigerator of claim 6, wherein the water supply case and the door basket are spaced apart from each other along a vertical axis of the refrigerator and are accessible while the outer door is open.

8. The refrigerator of claim 1, wherein the water supply case comprises a case bead, and a door basket couplable to the case bead and including a door-storage space.

9. The refrigerator of claim 1, further comprising a control valve configured to supply the water to the automatic water supplier until a predetermined water level is detected in the water container by the water level sensor.

10. The refrigerator of claim 9, wherein the water supply case comprises a valve installation space in which the control valve is mountable.

11. The refrigerator of claim 1, wherein the inner door comprises a front plate forming a front surface of the inner door;

a rear plate couplable to a rear side of the front plate;

an upper cap couplable to a top side of the front plate and a top side the rear plate;

a lower cap couplable to a bottom side of the front plate and a bottom side of the rear plate; and insulation arranged in a foaming space formed by the front plate, the rear plate, the upper cap and the lower cap, wherein the door opening is formed by at least one of the front plate or the rear plate.

* * * * *